US012448580B2

(12) United States Patent
Adhikari et al.

(10) Patent No.: US 12,448,580 B2
(45) Date of Patent: Oct. 21, 2025

(54) BIO-LUBRICANT COMPOSITIONS AND METHODS THEREOF

(71) Applicant: AUBURN UNIVERSITY, Auburn, AL (US)

(72) Inventors: Sushil Adhikari, Auburn, AL (US); Hossein Jahromi, Auburn, AL (US)

(73) Assignee: AUBURN UNIVERSITY, Auburn, AL (US)

( * ) Notice: Subject to any disclaimer, the term of this patent is extended or adjusted under 35 U.S.C. 154(b) by 347 days.

(21) Appl. No.: 17/939,427

(22) Filed: Sep. 7, 2022

(65) Prior Publication Data

US 2023/0136801 A1 May 4, 2023

Related U.S. Application Data

(60) Provisional application No. 63/241,830, filed on Sep. 8, 2021.

(51) Int. Cl.
*C10M 109/02* (2006.01)
*C10N 70/00* (2006.01)

(52) U.S. Cl.
CPC .... *C10M 109/02* (2013.01); *C10M 2207/401* (2013.01); *C10N 2070/00* (2013.01)

(58) Field of Classification Search
CPC ..... C10N 2030/64; C10N 2030/74; C10N 2070/00; C10N 2060/04; C10N 2060/02; C10N 2030/66; C10N 2030/02; C10M 177/00; C10M 109/02; C10M 169/04; C10M 175/0041; C10M 105/04; C10M 2203/045; C10M 2207/401; C10M 2203/0206
See application file for complete search history.

(56) References Cited

U.S. PATENT DOCUMENTS

| | | | | |
|---|---|---|---|---|
| 9,545,621 | B2 | 1/2017 | Kettunen et al. | |
| 9,587,179 | B2 | 3/2017 | Powell et al. | |
| 2009/0014354 | A1* | 1/2009 | Knuuttila | C10G 29/22 208/58 |
| 2012/0283493 | A1 | 11/2012 | Olson et al. | |
| 2013/0217932 | A1 | 8/2013 | Seck | |

(Continued)

FOREIGN PATENT DOCUMENTS

| | | | |
|---|---|---|---|
| WO | 200768797 | A2 | 6/2007 |
| WO | 2010005391 | A1 | 1/2010 |

OTHER PUBLICATIONS

PCT International Search Report and Written Opinion prepared for PCT/US2022/076023, completed Dec. 5, 2022, mailed Dec. 12, 2022.

(Continued)

*Primary Examiner* — Vishal V Vasisth
(74) *Attorney, Agent, or Firm* — Barnes & Thornburg LLP

(57) ABSTRACT

The present disclosure provides a method of producing a lubricant composition comprising the steps of hydrolyzing a starting material to provide a hydrolyzed product mixture, reacting the hydrolyzed product mixture under conditions capable of producing a condensation product mixture, contacting the condensation product mixture with a cyclic compound to provide a coupled product mixture, and hydrogenating the coupled product mixture to provide the lubricant composition. In addition, other methods and compositions thereof are also provided.

18 Claims, 30 Drawing Sheets

(56) References Cited

U.S. PATENT DOCUMENTS

2022/0025287 A1* 1/2022 Saha ..... C10M 105/04

OTHER PUBLICATIONS

Jahromi, H., Synthesis of novel bio-lubricants from waste cooking oil and cyclic oxygenates through an integrated catalytic process, Supporting Information, ACS Sustainable Chemistry & Engineering, 2021.

Jahromi, H., Synthesis of novel bio-lubricants from waste cooking oil and cyclic oxygenates through an integrated catalytic process, ACS Sustainable Chemistry & Engineering, 2021, 9, 13424-13437.

* cited by examiner

FIG. 2A
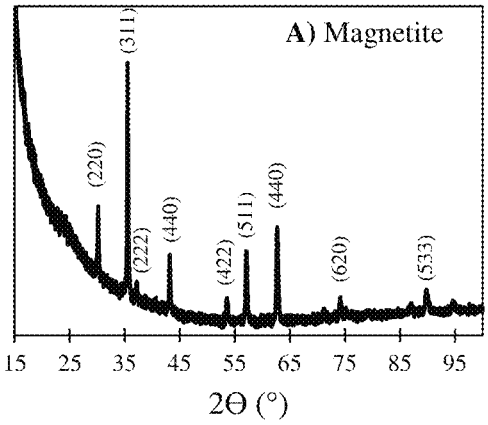
FIG. 2B
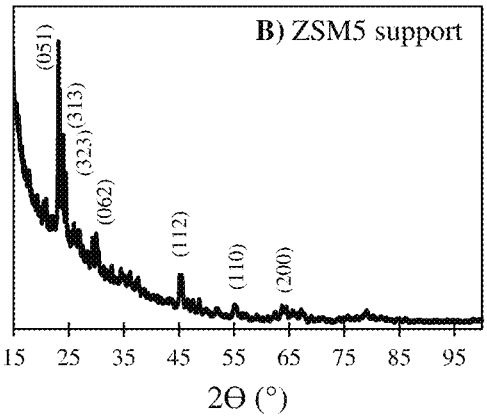
FIG. 2C
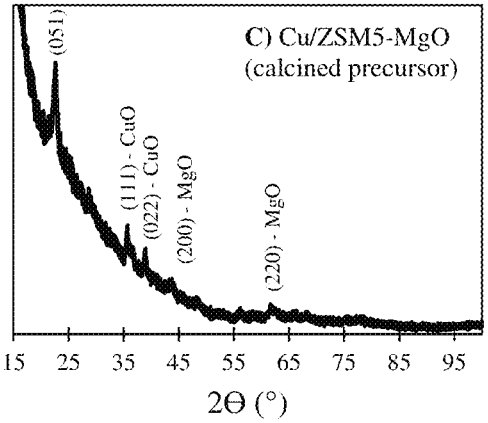
FIG. 2D
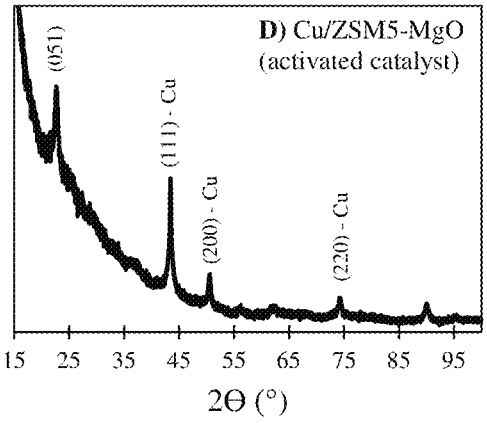
FIGURES 2A to 2D FIG. 24A
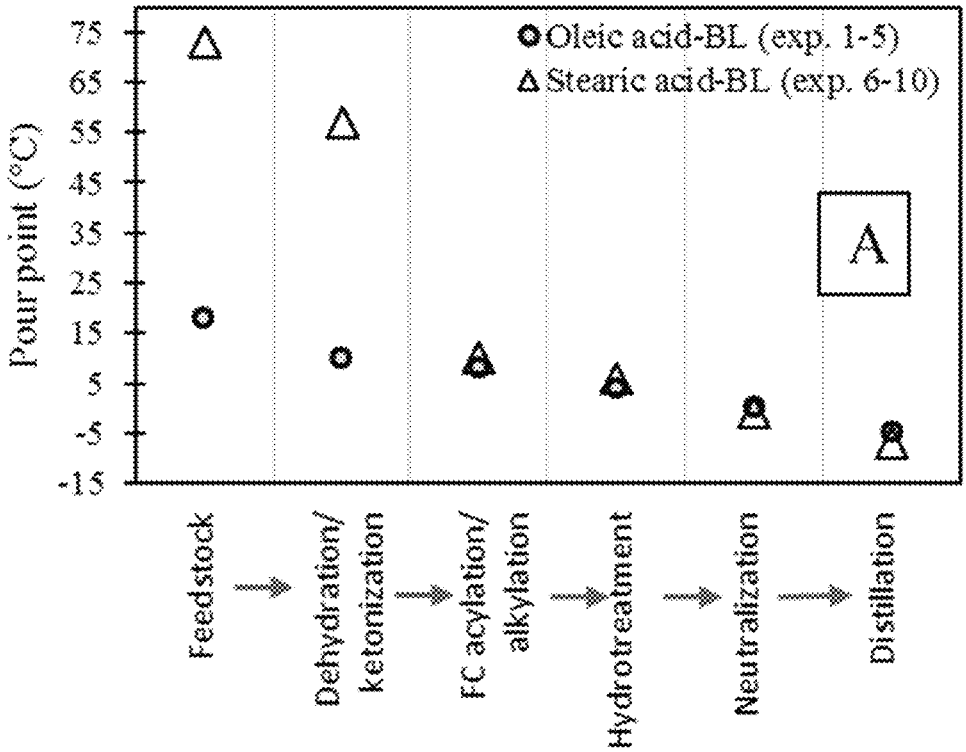
FIG. 24B
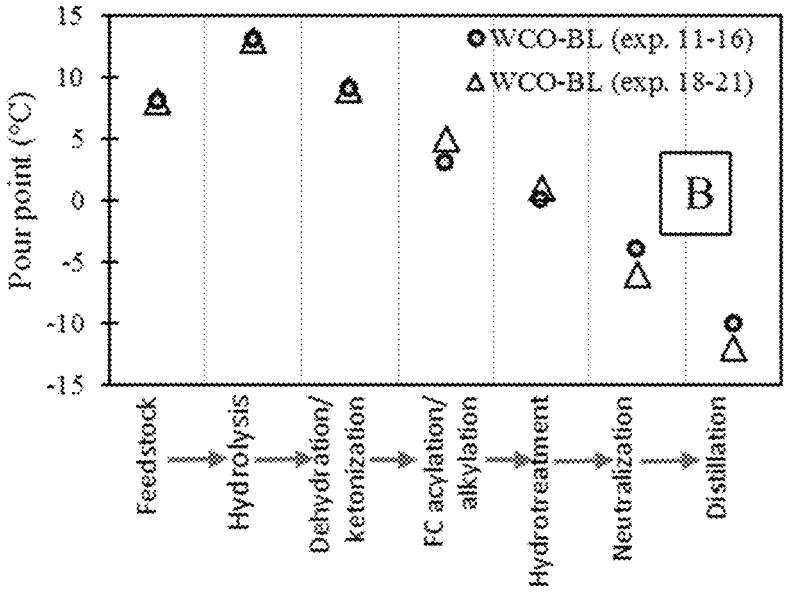
FIGURES 24A and 24B FIG. 25A
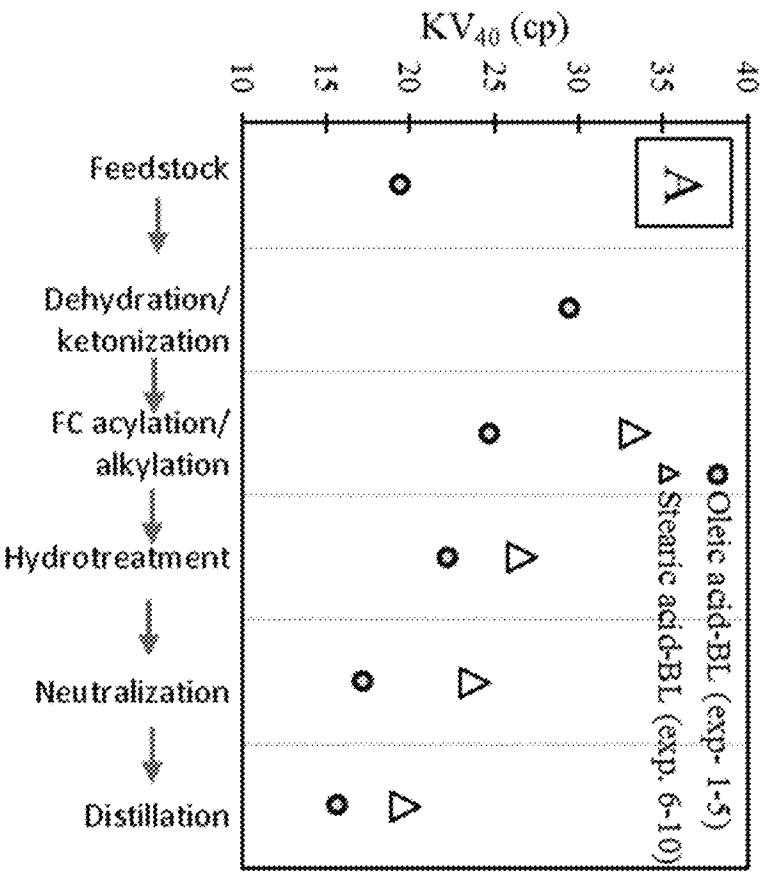
FIG. 25B
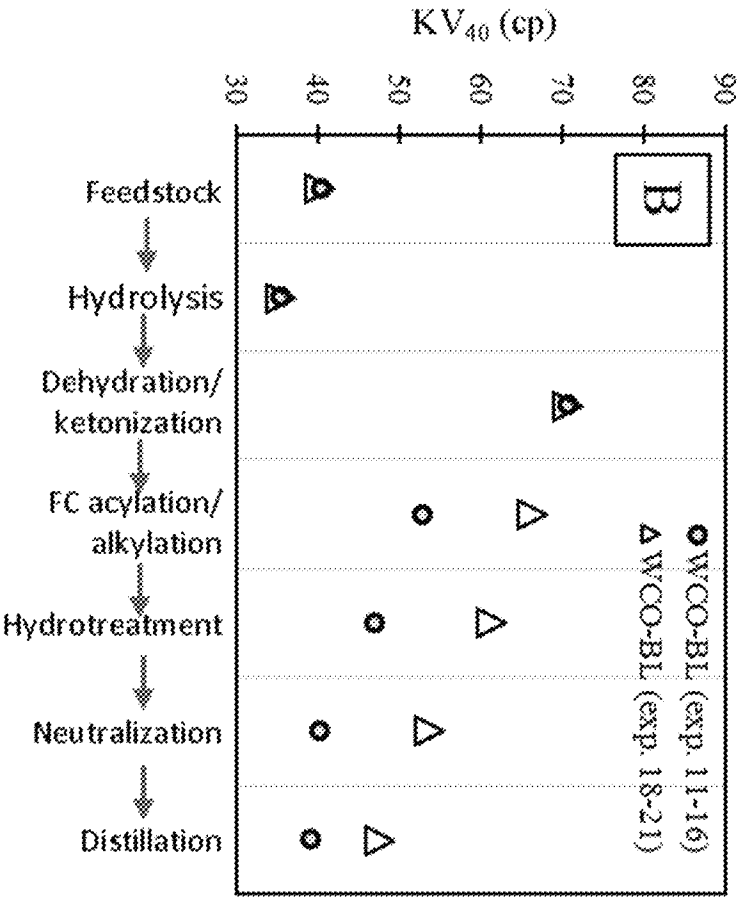
FIGURES 25A and 25B FIG. 26A
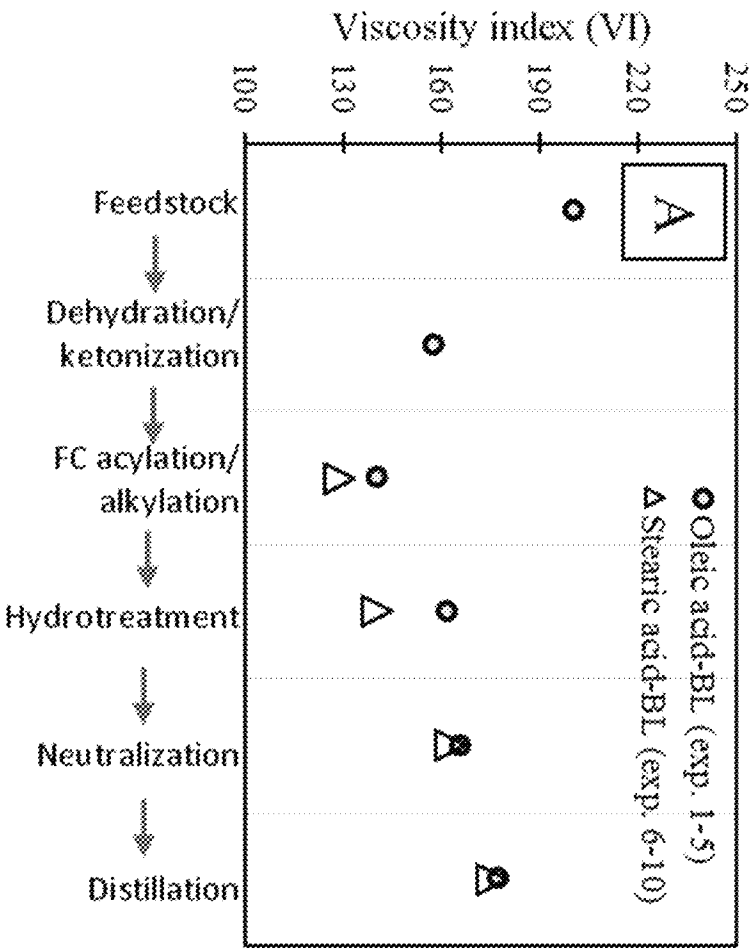
FIG. 26B
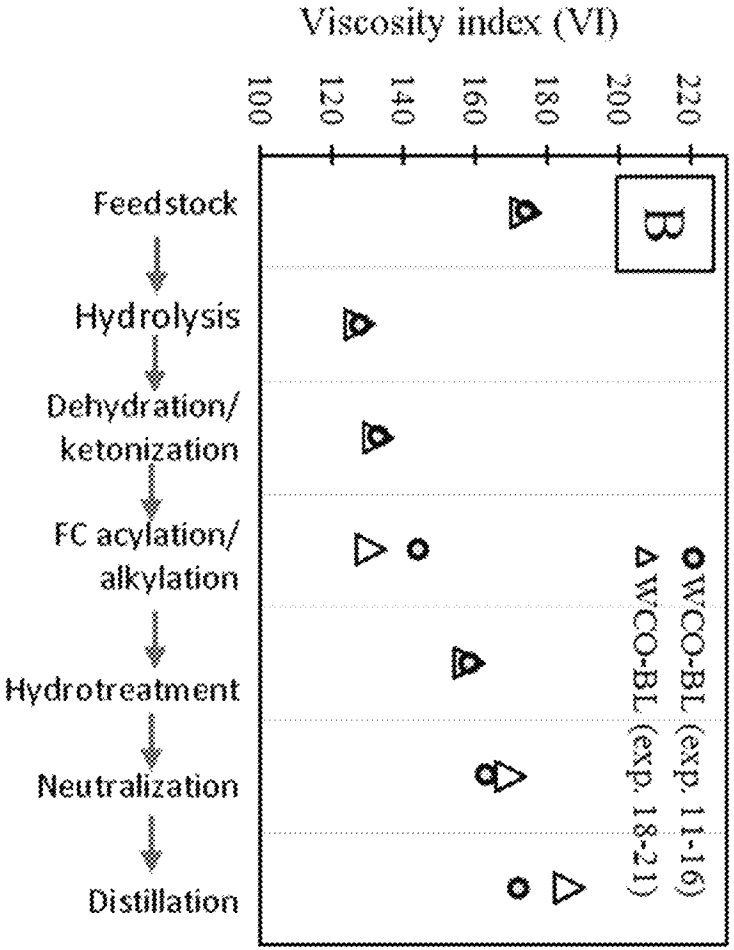
FIGURES 26A and 26B FIG. 27A
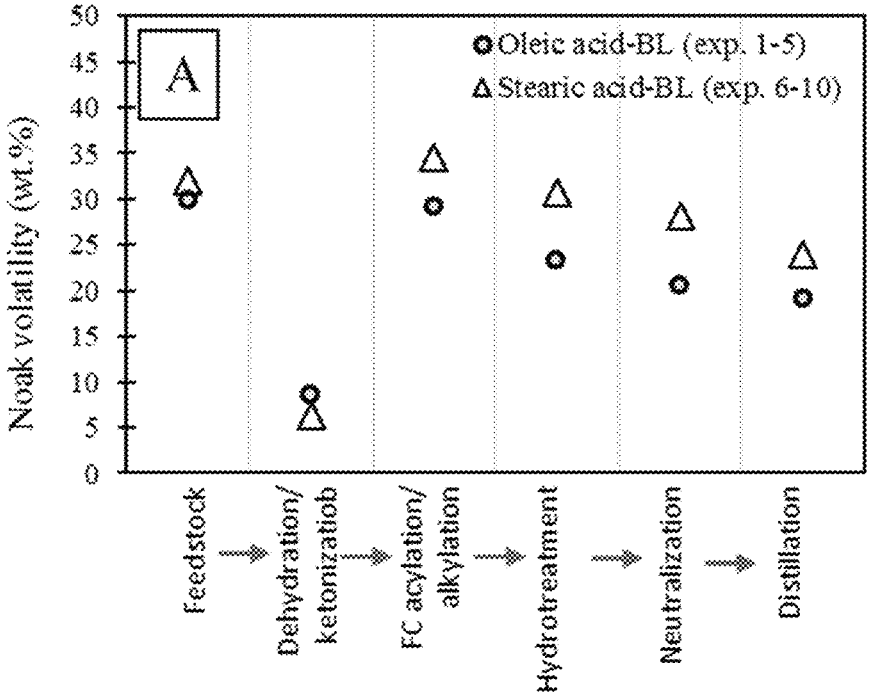
FIG. 27B
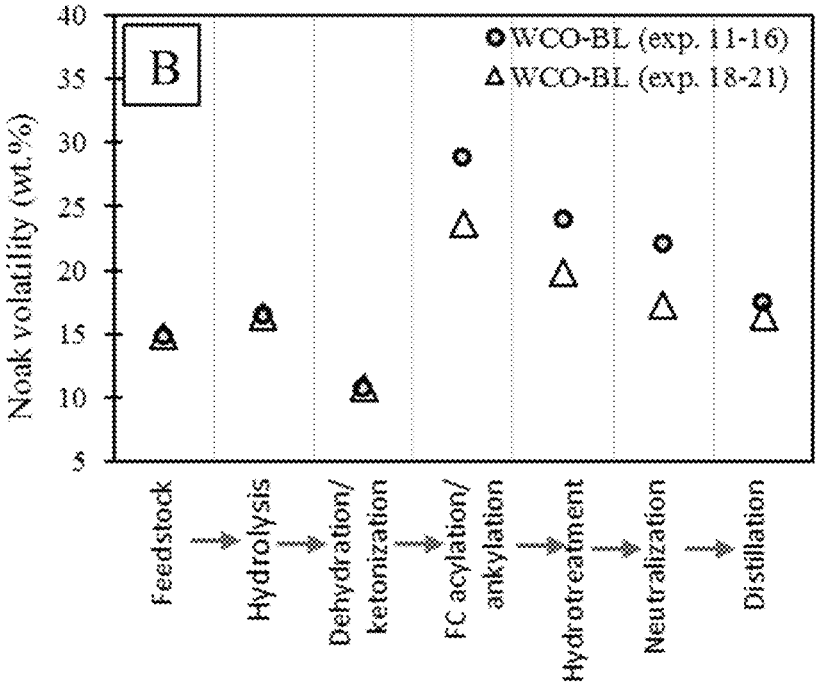
FIGURES 27A and 27B FIG. 28A
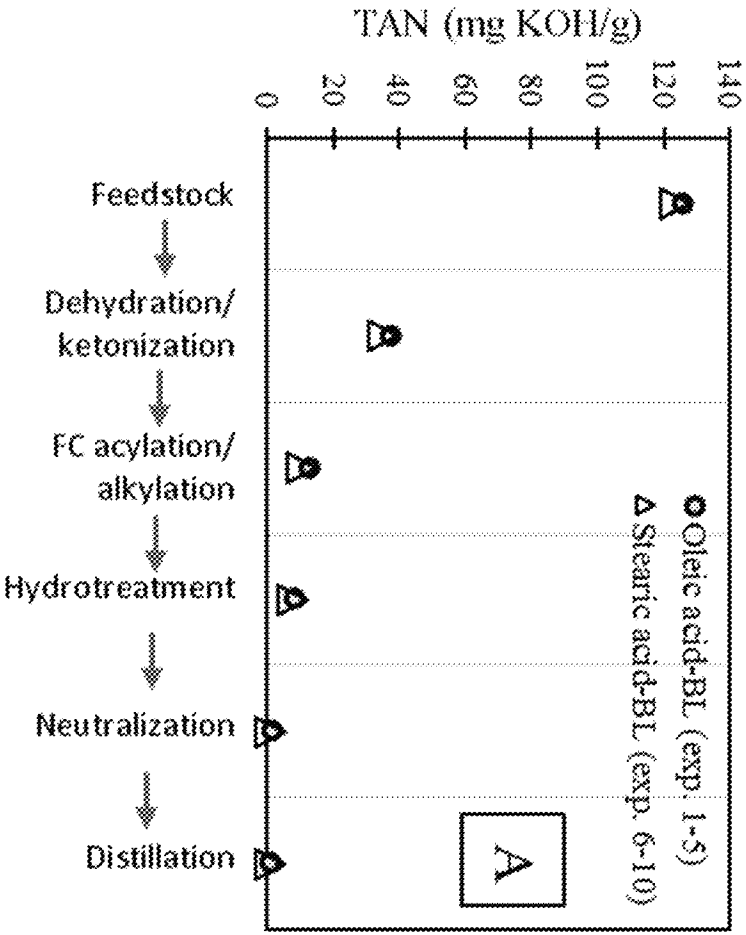
FIG. 28B
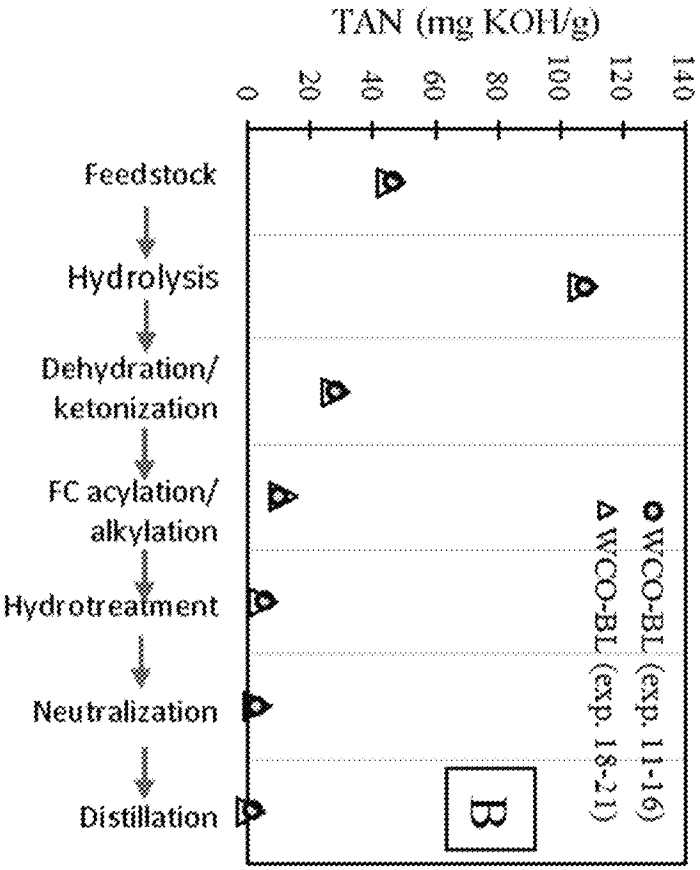
FIGURE 28A and 28B FIG. 30A
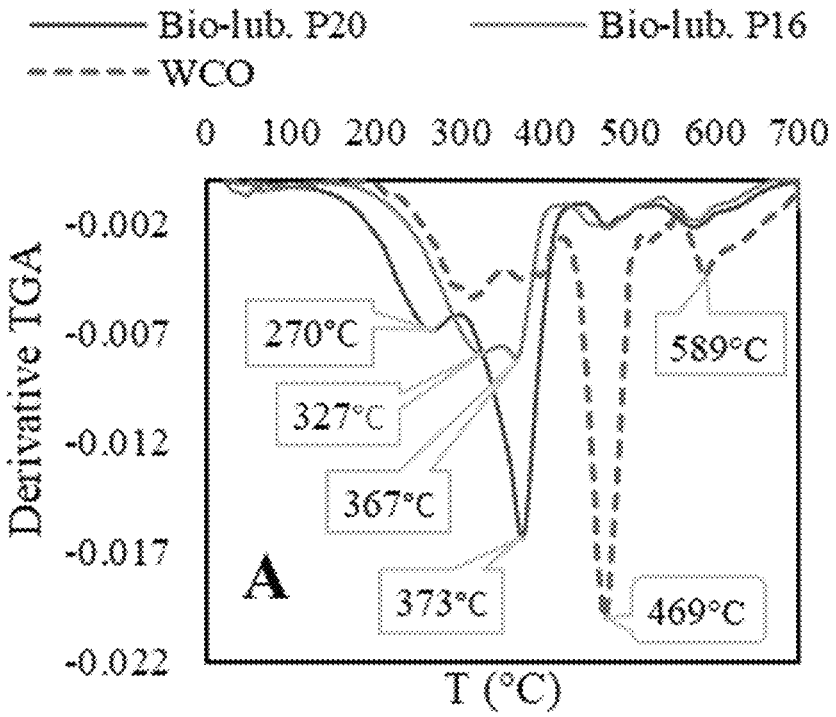
FIG. 30B
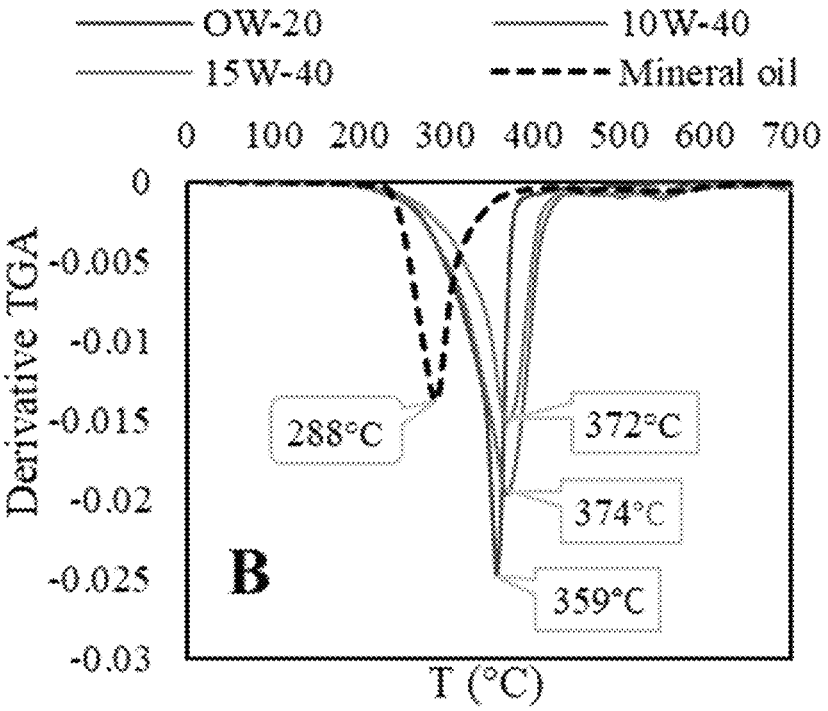
FIGURES 30A and 30B

BIO-LUBRICANT COMPOSITIONS AND METHODS THEREOF

CROSS-REFERENCE TO RELATED APPLICATIONS

This application claims the benefit under 35 USC § 119(e) of U.S. Provisional Application Ser. No. 63/241,830, filed on Sep. 8, 2021, the entire disclosure of which is incorporated herein by reference.

BACKGROUND AND SUMMARY OF THE INVENTION

The United States is the world's largest producer of waste cooking oils (WCOs). Annually, the U.S. produced 20 billion pounds of in 2007, representing 55% of global WCO production. It is expected that annual vegetable oil production by 2023 will be more than 115 billion pounds in the U.S., approximately 20 billion pounds of which will be consumed in edible products. As a result, significant amounts of WCO are available for the production of fuels and chemicals.

To date, most studies have focused on fuel (bio-diesel) production through traditional transesterification processes rather than synthesis of value added bio-products. However, the cost of biodiesel is a major drawback against its commercial availability. WCOs typically contain high amounts of C8 to C24 fatty acids with average molecular weights of about 850 g/mol and kinematic viscosity at 40° C. of about 35 cSt. In particular, C16 and C18 fatty acids with zero, one, or two double bonds account for more than 60% of WCOs. Although vegetable oils have relatively good lubricity qualities, they cannot serve as robust base oils for industrial machinery lubricants because of their low oxidative tolerance, poor solubility of additives in the oil, and poor low-temperature performance.

Bio-lubricants (BL) can refer to lubricants produced from natural raw materials such as vegetable and animal oils that are renewable, biodegradable, and non-toxic to humans, as well as being environmentally friendly. Raw vegetable oils have good lubricity, low viscosity, and relatively low pour point. Although virgin cooking oils may possess desirable lubricant properties such as low pour point and high viscosity index, their direct application as lubricant is quite unfavorable because of competition with food chain. Thus, waste cooking oils (WCOs) are considered a better alternative for biofuel and bio-lubricant (BL) feedstocks.

Additionally, thermal instability can render products to not be useful as lubricants. At high temperatures, triglycerides decompose to free fatty acids (FFAs), thus increasing the total acid number. Thereafter, FFAs undergo self-polymerization and form macromolecules with much higher viscosity and pour point. In addition, vegetable oils present extremely poor response to pour point depressants and additives because of lack of suitable chemical functionalities. WCOs require chemical modifications to restore their positive lubricant properties. Current developments for producing lubricants from vegetable oils rely on traditional (trans)esterification, etherification, and chemical modifications of triglycerides and free fatty acids (FFAs). However, the final products are undesirable as they suffer from poor low-temperature characteristics, low oxidation stability, low viscosity index, and/or poor solubility of additives. Therefore, there exists a need for an improved production process to provide lubricants with desirable characteristics.

Accordingly, the present disclosure provides improved biolubricant compositions and methods of making the same. For instance, the present disclosure provides an exemplary approach to produce bio-lubricants (BL) from the reaction of waste cooking oils (WCOs) and cyclic oxygenated hydrocarbons (COHCs) via a four-step pathway: hydrolysis, dehydration/ketonization, Friedel-Crafts (FC) acylation/alkylation, and hydrotreatment. This process is capable of producing biolubricants comprising molecules with several desirable properties, including but not limited to 1) long and linear hydrocarbon chains, 2) low to zero unsaturation, 3) minimal branching, 4) inclusion of naphthenic rings and cyclic structures, and 5) inclusion of polar molecules. The biolubricant compositions and methods of the present disclosure have numerous benefits compared to those known in the art. First, the biolubricant compositions may comprise favorable characteristics, including low-temperature characteristics, oxidation stability, viscosity index, or solubility of additives. Various characteristics may be characterized by pour point, kinematic viscosity (at 40° C.), viscosity index, and Noack volatility.

Other objects, features and advantages of the present disclosure will become apparent from the following detailed description. It should be understood, however, that the detailed description and the specific examples, while indicating specific embodiments of the invention, are given by way of illustration only, since various changes and modifications within the spirit and scope of the invention will become apparent to those skilled in the art from this detailed description.

BRIEF DESCRIPTION OF THE DRAWINGS

FIG. 2A shows the XRD patterns of heterogeneous catalyst, Magnetite. FIG. 2B shows the XRD patterns of heterogeneous catalyst, ZSM5 support. FIG. 2C shows the XRD patterns of heterogeneous catalyst, Cu/ZSM5-MgO (calcined precursor).

FIG. 2D shows the XRD patterns of heterogeneous catalyst, Cu/ZSM5-MgO (activated catalyst).

FIG. 24A shows trend of pour point changes during BL production from model compounds. FIG. 24B shows trend of pour point changes during BL production from waste cooking oil.

FIG. 25A shows trend of $KV_{40}$ changes during BL production from model compounds. FIG. 25B shows trend of $KV_{40}$ changes during BL production from waste cooking oil.

FIG. 26A shows trend of VI changes during BL production from model compounds. FIG. 26B shows trend of VI changes during BL production from waste cooking oil.

FIG. 27A shows trend of Noack volatility changes during bio-lubricant production from model compounds. FIG. 27B shows trend of Noack volatility changes during bio-lubricant production from waste cooking oil.

FIG. 28A shows trend of TAN changes during BL production from A) model compounds. FIG. 28B shows trend of TAN changes during BL production from waste cooking oil.

FIG. 30A shows TGA of bio-lubricants. FIG. 30B shows TGA of commercial mineral oil & engine oils

DETAILED DESCRIPTION

Figure 1:
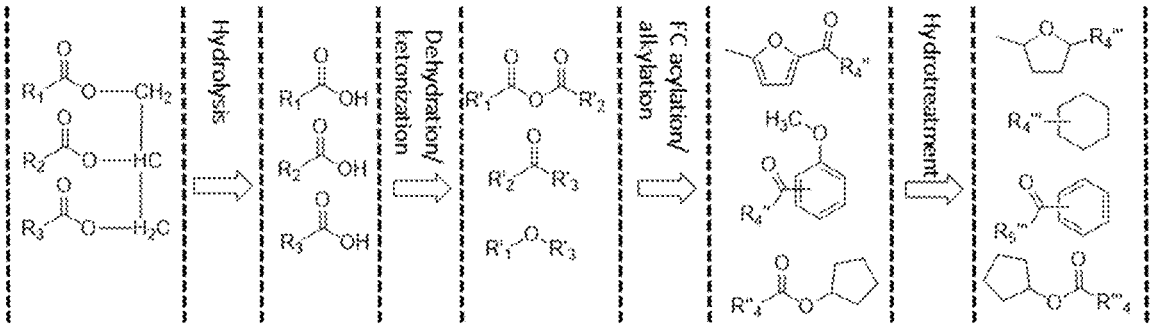
FIG. 1 shows an integrated reaction scheme for production of BL from WCO.

Various embodiments of the invention are described herein as follows. In an illustrative aspect, a method of producing a lubricant composition is provided. The method comprises the steps of hydrolyzing a starting material to provide a hydrolyzed product mixture, reacting the hydrolyzed product mixture under conditions capable of producing a condensation product mixture, contacting the condensation product mixture with a cyclic compound to provide a coupled product mixture, and hydrogenating the coupled product mixture to provide the lubricant composition.

In an embodiment, the lubricant composition is a biolubricant. The term biolubricant is referred to herein according to common knowledge in the art, for instance a lubricant that is capable of being produced or obtained from natural raw materials. Such biolubricants can be renewable, biodegradable, nontoxic, and/or environmentally friendly. In an embodiment, the biolubricant is obtained from a non-synthetic starting material. In an embodiment, the non-synthetic starting material is selected from the group consisting of a vegetable oil, an animal oil, and a combination thereof. In an embodiment, the non-synthetic material is a vegetable oil. In an embodiment, the non-synthetic material is an animal oil. As described herein, an animal oil or animal fat can interchangeably refer to oils or fats obtained from an animal. For instance, the animal oil may be provided from the cooking of an animal or an animal part. For instance, an animal oil can include one or more animal fats.

In an embodiment, the lubricant composition comprises a mixture of one or more lubricants. For instance, the lubricant composition can be a mixture of various components that can be characterized as lubricants and/or biolubricants. In an embodiment, a lubricant can comprise a mixture of hydrocarbons with any suitable functionalization. For instance, the hydrocarbons may vary in length, saturation, branching, substituents, and heteroatom content. In an embodiment, the lubricant comprises a mixture of one or more cyclic oxygenated hydrocarbons (COHCs). In an embodiment, a lubricant can include a base oil and an additive. In an embodiment, a lubricant can be a base oil.

In an embodiment, the hydrolyzing of step i) is performed in the presence of a catalyst. In an embodiment, the catalyst is selected from the group consisting of an acid, a base, a metal oxide, and any combination thereof.

In an embodiment, the catalyst is an acid. In an embodiment, the acid is an inorganic acid or organic acid. In an embodiment, the acid is a solid acid. In an embodiment, the acid is a homogenous or heterogeneous acid. In an embodiment, the acid is a sulfuric acid or a sulfonic acid. In an embodiment, the acid is a sulfuric acid. In an embodiment, the acid is a sulfonic acid.

In an embodiment, the catalyst is a base. In an embodiment, the catalyst is a metal oxide. In an embodiment, the metal oxide is $TiO_2$.

In an embodiment, the starting material is a non-synthetic starting material. In an embodiment, the starting material is an oil. In an embodiment, the oil is a cooking oil. In an embodiment, the cooking oil is selected from the group consisting of a vegetable oil, an animal oil, and any combination thereof. In an embodiment, the cooking oil is a vegetable oil. In an embodiment, the cooking oil is an animal oil.

In an embodiment, the oil is a waste cooking oil. In an embodiment, the waste cooking oil is selected from the group consisting of a vegetable oil, animal oil, and combination thereof. In an embodiment, the waste cooking oil is obtained from cooking processes. For instance, the waste cooking oil can be obtained from the preparation of food. In an embodiment, the waste cooking oil is a vegetable oil. In an embodiment, the waste cooking oil is an animal oil.

In an embodiment, the oil is a crude oil. In an embodiment, the oil is a purified oil. In an embodiment, the purified oil is provided by a filtration step, a water removal step, or any combination thereof. In an embodiment, the purified oil is provided by a filtration step. In an embodiment, the purified oil is provided by a water removal step.

In an embodiment, the starting material comprises one or more triglycerides, one or more fatty acids, and a combination thereof. In an embodiment, the starting material comprises one or more triglycerides.

In an embodiment, the starting material comprises one or more fatty acids. In an embodiment, the fatty acid comprises a C5 to C40 fatty acid.

In an embodiment, the hydrolyzed product mixture comprises one or more carboxylic acids. In an embodiment, the carboxylic acid comprises one or more fatty acids. In an embodiment, the fatty acid comprises a C5 to C40 fatty acid.

In an embodiment, the reacting of step ii) comprises a dehydration reaction. In an embodiment, the reacting of step ii) comprises a ketonization reaction.

In an embodiment, the reacting of step ii) is performed in the presence of a catalyst. In an embodiment, the catalyst is selected from the group consisting of an acid, a metal, a metal oxide, a zeolite, and any combination thereof. In an embodiment, the catalyst is an acid. In an embodiment, the acid is selected from the group comprising a formic acid, a sulfuric acid, a Lewis acid, an acid halide, and any combination thereof.

In an embodiment, the catalyst comprises a metal. In an embodiment, the metal comprises cobalt. In an embodiment, the metal comprises nickel. In an embodiment, the catalyst is a metal oxide. In an embodiment, the metal oxide is selected from the group consisting of $ZrO_2$, $ZrO_2/H_2SO_4$, $Fe_3O_4$, $TiO_2$, $B_2O_3$, $WO_3$, PbO, MgO, CoO, $Al_2O_3$, $SiO_2$, $SiO_2/Al_2O_3$, and any combination thereof. In an embodiment, the catalyst is a zeolite. In an embodiment, the zeolite is erionite, gmelinite, mordenite, or ZSM-5. In an embodiment, the catalyst is montmorillonite.

In an embodiment, the condensation product mixture of step ii) comprises an anhydride, a ketone, an ether, an acyl halide, an arene, and any combination thereof. In an embodiment, the condensation product mixture of step ii) comprises an anhydride. In an embodiment, the condensation product mixture of step ii) comprises a ketone. In an embodiment, the condensation product mixture of step ii) comprises an ether. In an embodiment, the condensation product mixture of step ii) comprises an acyl halide. In an embodiment, the condensation product mixture of step ii) comprises an arene.

In an embodiment, the contacting of step iii) comprises an alkylation reaction, an acylation reaction, an esterification reaction, or an etherification reaction. For instance, the reaction performed according to step iii) can utilize a Friedel-Crafts reaction as it is commonly understood in the art. For instance, a Friedel-Crafts reaction can be an alkylation or an acylation. A Friedel-Crafts reaction can also be utilized to functionalize a cyclic aromatic compound. For instance, the reaction performed according to step iii) can utilize a Fischer reaction as it is commonly understood in the art including, for example, an esterification.

In an embodiment, the contacting of step iii) is performed in the presence of a catalyst. In an embodiment, the catalyst is selected from the group consisting of an acid, a metal, a metal oxide, a zeolite, and any combination thereof. In an embodiment, the catalyst is an acid. In an embodiment, the acid is a Lewis acid. In an embodiment, the Lewis acid is $AlCl_3$ or $FeCl_3$.

In an embodiment, the catalyst comprises a metal. In an embodiment, the catalyst is a metal oxide. In an embodiment, the metal oxide is selected from the group consisting of $ZrO_2$, $Fe_3O_4$, $TiO_2$, $B_2O_3$, $WO_3$, PbO, MgO, CoO, $Al_2O_3$, $SiO_2$, $SiO_2$—$Al_2O_3$, and any combination thereof. In an embodiment, the catalyst is a zeolite. In an embodiment, the zeolite is metal-loaded or beta zeolite-based. In an embodiment, the zeolite is selected from the group consisting of erionite, gmelinite, mordenite, ZSM-5, Cu/ZSM-5-MgO, and any combination thereof. In an embodiment, the catalyst is montmorillonite.

In an embodiment, the cyclic compound of step iii) is a compound is selected from the group consisting of an aliphatic compound, an aromatic compound, a heterocyclic compound, a heteroaromatic compound, and any combination thereof.

In an embodiment, the cyclic compound of step iii) is an aliphatic compound. In an embodiment, the aliphatic compound is selected from the group consisting of a cyclic C4-C10 alcohol, a cyclic C4-C10 ketone, or a cyclic C4-C10 acyl halide. In an embodiment, the aliphatic compound is a cyclic C4-C10 alcohol. In an embodiment, the cyclic C4-C10 alcohol is, cyclohexanol or cyclopentanol. In an embodiment, the aliphatic compound is a cyclic C4-C10 ketone. In an embodiment, the cyclic C4-C10 ketone is cyclohexanone or cyclopentanone.

In an embodiment, the cyclic compound of step iii) is an aromatic compound. In an embodiment, the aromatic compound is a C5-C12 monocyclic or bicyclic compound. In an embodiment, the aromatic compound is an aromatic amine, phenol, aldehyde, ketone, amide, diol, dione, acyl halide, or halide. In an embodiment, the aromatic compound is a phenyl, biphenyl, phenol, anisole, guaiacol, aniline, catechol, naphthalene.

In an embodiment, the cyclic compound of step iii) is a heterocyclic compound. In an embodiment, the heterocyclic compound is a cyclic C4-C10 with independently one or more heteroatoms of 0, N, or S. In an embodiment, the cyclic C4-C10 is a tetrahydrofuran, pyrrolidine, piperidine, tetrahydrothiophene, or morpholine.

In an embodiment, the cyclic compound of step iii) is a heteroaromatic compound. In an embodiment, the heteroaromatic compound is a monocyclic or bicyclic C4-C12 with independently one or more heteroatoms of O, N, or S. In an embodiment, the monocyclic or bicyclic C4-C12 is a furan, furfural, pyridine, thiophene, morpholine, quinoline.

In an embodiment, the coupled product mixture of step iii) comprises an ester. In an embodiment, the coupled product mixture of step iii) comprises a ketone.

In an embodiment, the step of contacting the condensation product mixture with a cyclic compound is optionally performed multiple times. In an embodiment, the step of contacting the condensation product mixture with a cyclic compound is optionally performed 2 times, 3 times, 4 times, 5 times, or 6 times. In an embodiment, for each step of contacting, the cyclic compound is independently selected. For instance, if multiple steps of contacting are performed, a single cyclic compound can be utilized in each of the independent steps. In addition, if multiple steps of contacting are performed, more than one cyclic compound can be utilized for the each of the independent steps.

In an embodiment, the hydrogenating of step iv) comprises a hydrotreatment. In an embodiment, the hydrotreatment comprises a hydro(deoxy)genation.

In an embodiment, the hydrogenating of step iv) is performed in the presence of a catalyst. In an embodiment, the catalyst comprises one or more transition metal, one or more noble metal, or any combination thereof. In an embodiment, the catalyst comprises a transition metal. In an embodiment, the catalyst comprises a noble metal. In an embodiment, the catalyst comprises a support. In an embodiment, the support comprises a metal oxide or carbon. In an embodiment, the catalyst is $Ni/Al_2O_3$, $CoMo/Al_2O_3$, $NiMo/Al_2O_3$, Ru/C, Pt/C, Pd/C, NiMo/C, or CoMo/C.

In an embodiment, the method further comprises a step of neutralizing the lubricant composition. In an embodiment, the neutralizing step comprises adding an acid or a base. In an embodiment, the acid is selected from the group consisting of hydrochloric acid, sulfuric acid, acetic acid, nitric acid, formic acid, and any combination thereof. In an embodiment, the base is sodium hydroxide, potassium hydroxide, or a combination thereof.

In an embodiment, any one of the steps of the method may be performed at a suitable temperature. In an embodiment, step i), step ii), step iii), or step iv) may be optionally independently performed at an elevated temperature. For instance, an elevated temperature may fall in any of the following ranges: above about 25° C., above about 40° C., above about 60° C., above about 100° C., above about 150° C., above about 200° C., above about 250° C., above about 300° C., between about 25° C. and about 400° C., between about 40° C. and about 100° C., and between about 200° C. and about 400° C.

In an illustrative aspect, a second method of producing a lubricant composition is provided. The method comprises the steps of reacting a starting material to provide a condensation product mixture, contacting the condensation product mixture with a cyclic compound to provide a coupled product mixture, and hydrogenating the coupled product mixture to provide the lubricant composition. The previously described embodiments of the first method of producing a lubricant composition are applicable to the second method of producing a lubricant composition animal described herein.

In an illustrative aspect, a lubricant composition is provided. The lubricant composition is produced according to one of the methods of producing a lubricant composition described herein.

In an embodiment, the lubricant composition comprises an additive. In an embodiment, the additive is selected from the group consisting of a surface protective additive, a performance additive, a lubricant protective additive, and any combination thereof.

In an embodiment, the additive comprises a surface protective additive. In an embodiment, the surface protective additive is selected from the group consisting of an anti-wear agent, a corrosion and rust inhibitor, a detergent, a dispersant, a friction modifier, and any combination thereof. In an embodiment, the surface protective additive is an anti-wear agent. In an embodiment, the anti-wear agent comprises one or more of a zinc dithiophosphate, an organic phosphate, an acid phosphate, an organic sulfur, a chlorine compound, a sulfurized fat, a sulfide, and a disulfide. In an embodiment, the surface protective additive is a corrosion and rust inhibitor. In an embodiment, the corrosion and rust inhibitor comprises one or more of a zinc dithiophosphate, a metal phenolate, a basic metal sulfonate, a fatty acid, and an amine.

In an embodiment, the surface protective additive is a detergent. In an embodiment, the detergent comprises one or more metallo-organic compounds. In an embodiment, the metallo-organic compound is selected from the group consisting of barium, calcium phenolate, magnesium phenolate, phosphate, and sulfonate.

In an embodiment, the surface protective additive is a dispersant. In an embodiment, the dispersant comprises one or more of a polymeric alkylthiophosphonate, an alkylsuccinimide, and an organic complex containing nitrogen. In an embodiment, the surface protective additive is a friction modifier. In an embodiment, the friction modifier comprises one or more of an organic fatty acid, an amine, a lard oil, a high molecular weight organic phosphorus, and phosphoric acid ester.

In an embodiment, the additive comprises a performance additive. In an embodiment, the performance additive is selected from the group consisting of a pour point depressant, a seal swell agent, a viscosity improver, and any combination thereof. In an embodiment, the performance additive is a pour point depressant. In an embodiment, the pour point depressant comprises one or more of an alkylated naphthalene, a phenolic polymer, and a polymethacrylate.

In an embodiment, the performance additive is a seal swell agent. In an embodiment, the seal swell agent comprises one or more of an organic phosphate, an aromatic, and a halogenated hydrocarbon. In an embodiment, the performance additive is a viscosity additive. In an embodiment, the viscosity additive comprises one or more of a polymer of methacrylate, a copolymer of methacrylate, a butadiene olefin, and an alkylated styrene.

In an embodiment, the additive comprises a lubricant protective additive. In an embodiment, the lubricant protective additive is selected from the group consisting of an anti-foaming agent, an antioxidant, a metal deactivator, and any combination thereof. In an embodiment, the lubricant protective additive is an anti-foaming agent. In an embodiment, the anti-foaming agent comprises a silicone polymer, an organic copolymer, or a combination thereof.

In an embodiment, the lubricant protective additive is an antioxidant. In an embodiment, the antioxidant comprises one or more of a zinc dithiophosphate, a hindered phenol, an aromatic amine, and a sulfurized phenol. In an embodiment, the lubricant protective additive is a metal deactivator. In an embodiment, the metal deactivator comprises one or more of an organic complex containing nitrogen or a sulfur, an amine, a sulfide, and a phosphite.

The following numbered embodiments are contemplated and are non-limiting:

1. A method of producing a lubricant composition, said method comprising the steps of
   i. hydrolyzing a starting material to provide a hydrolyzed product mixture,
   ii. reacting the hydrolyzed product mixture under conditions capable of producing a condensation product mixture,
   iii. contacting the condensation product mixture with a cyclic compound to provide a coupled product mixture, and
   iv. hydrogenating the coupled product mixture to provide the lubricant composition.
2. The method of clause 1, any other suitable clause, or any combination of suitable clauses, wherein the lubricant composition is a biolubricant.
3. The method of clause 2, any other suitable clause, or any combination of suitable clauses, wherein the biolubricant is produced from a non-synthetic starting material.
4. The method of clause 3, any other suitable clause, or any combination of suitable clauses, wherein the non-synthetic starting material is selected from the group consisting of a vegetable oil, an animal oil, and a combination thereof.
5. The method of clause 3, any other suitable clause, or any combination of suitable clauses, wherein the non-synthetic material is a vegetable oil.
6. The method of clause 3, any other suitable clause, or any combination of suitable clauses, wherein the non-synthetic material is an animal oil.
7. The method of clause 1, any other suitable clause, or any combination of suitable clauses, wherein the lubricant composition comprises a mixture of one or more lubricants.
8. The method of clause 7, any other suitable clause, or any combination of suitable clauses, wherein the lubricant comprises a mixture of one or more cyclic oxygenated hydrocarbons (COHCs).
9. The method of clause 1, any other suitable clause, or any combination of suitable clauses, wherein the hydrolyzing of step i) is performed in the presence of a catalyst.
10. The method of clause 9, any other suitable clause, or any combination of suitable clauses, wherein the catalyst is selected from the group consisting of an acid, a base, a metal oxide, and any combination thereof.
11. The method of clause 9, any other suitable clause, or any combination of suitable clauses, wherein the catalyst is an acid.
12. The method of clause 11, any other suitable clause, or any combination of suitable clauses, wherein the acid is an inorganic acid or organic acid.
13. The method of clause 11, any other suitable clause, or any combination of suitable clauses, wherein the acid is a solid acid.
14. The method of clause 11, any other suitable clause, or any combination of suitable clauses, wherein the acid is a homogenous or heterogeneous acid.
15. The method of clause 11, any other suitable clause, or any combination of suitable clauses, wherein the acid is a sulfuric acid or a sulfonic acid.
16. The method of clause 11, any other suitable clause, or any combination of suitable clauses, wherein the acid is a sulfuric acid.

17. The method of clause 11, any other suitable clause, or any combination of suitable clauses, wherein the acid is a sulfonic acid.
18. The method of clause 9, any other suitable clause, or any combination of suitable clauses, wherein the catalyst is a base.
19. The method of clause 9, any other suitable clause, or any combination of suitable clauses, wherein the catalyst is a metal oxide.
20. The method of clause 19, any other suitable clause, or any combination of suitable clauses, wherein the metal oxide is $TiO_2$.
21. The method of clause 1, any other suitable clause, or any combination of suitable clauses, wherein the starting material is a non-synthetic starting material.
22. The method of clause 1, any other suitable clause, or any combination of suitable clauses, wherein the starting material is an oil.
23. The method of clause 22, any other suitable clause, or any combination of suitable clauses, wherein the oil is a cooking oil.
24. The method of clause 23, any other suitable clause, or any combination of suitable clauses, wherein the cooking oil is selected from the group consisting of a vegetable oil, an animal oil, and any combination thereof.
25. The method of clause 23, any other suitable clause, or any combination of suitable clauses, wherein the cooking oil is a vegetable oil.
26. The method of clause 23, any other suitable clause, or any combination of suitable clauses, wherein the cooking oil is an animal oil.
27. The method of clause 22, any other suitable clause, or any combination of suitable clauses, wherein the oil is a waste cooking oil.
28. The method of clause 27, any other suitable clause, or any combination of suitable clauses, wherein the waste cooking oil is selected from the group consisting of a vegetable oil, animal oil, and combination thereof.
29. The method of clause 27, any other suitable clause, or any combination of suitable clauses, wherein the waste cooking oil is a vegetable oil.
30. The method of clause 27, any other suitable clause, or any combination of suitable clauses, wherein the waste cooking oil is an animal oil.
31. The method of clause 22, any other suitable clause, or any combination of suitable clauses, wherein the oil is a crude oil.
32. The method of clause 22, any other suitable clause, or any combination of suitable clauses, wherein the oil is a purified oil.
33. The method of clause 32, any other suitable clause, or any combination of suitable clauses, wherein the purified oil is provided by a filtration step, a water removal step, or any combination thereof.
34. The method of clause 32, any other suitable clause, or any combination of suitable clauses, wherein the purified oil is provided by a filtration step.
35. The method of clause 32, any other suitable clause, or any combination of suitable clauses, wherein the purified oil is provided by a water removal step.
36. The method of clause 1, any other suitable clause, or any combination of suitable clauses, wherein the starting material comprises one or more triglycerides, one or more fatty acids, and a combination thereof.
37. The method of clause 36, any other suitable clause, or any combination of suitable clauses, wherein the starting material comprises one or more triglycerides.
38. The method of clause 36, any other suitable clause, or any combination of suitable clauses, wherein the starting material comprises one or more fatty acids.
39. The method of clause 38, any other suitable clause, or any combination of suitable clauses, wherein the fatty acid comprises a C5 to C40 fatty acid.
40. The method of clause 1, any other suitable clause, or any combination of suitable clauses, wherein the hydrolyzed product mixture comprises one or more carboxylic acids.
41. The method of clause 40, any other suitable clause, or any combination of suitable clauses, wherein the carboxylic acid comprises one or more fatty acids.
42. The method of clause 41, any other suitable clause, or any combination of suitable clauses, wherein the fatty acid comprises a C5 to C40 fatty acid.
43. The method of clause 1, any other suitable clause, or any combination of suitable clauses, wherein the reacting of step ii) comprises a dehydration reaction.
44. The method of clause 1, any other suitable clause, or any combination of suitable clauses, wherein the reacting of step ii) comprises a ketonization reaction.
45. The method of clause 1, any other suitable clause, or any combination of suitable clauses, wherein the reacting of step ii) is performed in the presence of a catalyst.
46. The method of clause 45, any other suitable clause, or any combination of suitable clauses, wherein the catalyst is selected from the group consisting of an acid, a metal, a metal oxide, a zeolite, and any combination thereof.
47. The method of clause 45, any other suitable clause, or any combination of suitable clauses, wherein the catalyst is an acid.
48. The method of clause 47, any other suitable clause, or any combination of suitable clauses, wherein the acid is selected from the group comprising a formic acid, a sulfuric acid, a Lewis acid, an acid halide, and any combination thereof.
49. The method of clause 45, any other suitable clause, or any combination of suitable clauses, wherein the catalyst comprises a metal.
50. The method of clause 49, any other suitable clause, or any combination of suitable clauses, wherein the metal comprises cobalt.
51. The method of clause 49, any other suitable clause, or any combination of suitable clauses, wherein the metal comprises nickel.
52. The method of clause 45, any other suitable clause, or any combination of suitable clauses, wherein the catalyst is a metal oxide.
53. The method of clause 52, any other suitable clause, or any combination of suitable clauses, wherein the metal oxide is selected from the group consisting of $ZrO_2$, $ZrO_2/H_2SO_4$, $Fe_3O_4$, $TiO_2$, $B_2O_3$, $WO_3$, PbO, MgO, CoO, $Al_2O_3$, $SiO_2$, $SiO_2/Al_2O_3$, and any combination thereof.
54. The method of clause 45, any other suitable clause, or any combination of suitable clauses, wherein the catalyst is a zeolite.
55. The method of clause 54, any other suitable clause, or any combination of suitable clauses, wherein the zeolite is erionite, gmelinite, mordenite, or ZSM-5.

56. The method of clause 45, any other suitable clause, or any combination of suitable clauses, wherein the catalyst is montmorillonite.
57. The method of clause 1, any other suitable clause, or any combination of suitable clauses, wherein the condensation product mixture of step ii) comprises an anhydride, a ketone, an ether, an acyl halide, an arene, and any combination thereof.
58. The method of clause 1, any other suitable clause, or any combination of suitable clauses, wherein the condensation product mixture of step ii) comprises an anhydride.
59. The method of clause 1, any other suitable clause, or any combination of suitable clauses, wherein the condensation product mixture of step ii) comprises a ketone.
60. The method of clause 1, any other suitable clause, or any combination of suitable clauses, wherein the condensation product mixture of step ii) comprises an ether.
61. The method of clause 1, any other suitable clause, or any combination of suitable clauses, wherein the condensation product mixture of step ii) comprises an acyl halide.
62. The method of clause 1, any other suitable clause, or any combination of suitable clauses, wherein the condensation product mixture of step ii) comprises an arene.
63. The method of clause 1, any other suitable clause, or any combination of suitable clauses, wherein the contacting of step iii) comprises an alkylation reaction, an acylation reaction, an esterification reaction, or an etherification reaction.
64. The method of clause 1, any other suitable clause, or any combination of suitable clauses, wherein the contacting of step iii) is performed in the presence of a catalyst.
65. The method of clause 64, any other suitable clause, or any combination of suitable clauses, wherein the catalyst is selected from the group consisting of an acid, a metal, a metal oxide, a zeolite, and any combination thereof.
66. The method of clause 65, any other suitable clause, or any combination of suitable clauses, wherein the catalyst is an acid.
67. The method of clause 66, any other suitable clause, or any combination of suitable clauses, wherein the acid is a Lewis acid.
68. The method of clause 67, any other suitable clause, or any combination of suitable clauses, wherein the Lewis acid is $AlCl_3$ or $FeCl_3$.
69. The method of clause 65, any other suitable clause, or any combination of suitable clauses, wherein the catalyst comprises a metal.
70. The method of clause 65, any other suitable clause, or any combination of suitable clauses, wherein the catalyst is a metal oxide.
71. The method of clause 70, any other suitable clause, or any combination of suitable clauses, wherein the metal oxide is selected from the group consisting of $ZrO_2$, $Fe_3O_4$, $TiO_2$, $B_2O_3$, $WO_3$, PbO, MgO, CoO, $Al_2O_3$, $SiO_2$, $SiO_2$—$Al_2O_3$, and any combination thereof.
72. The method of clause 65, any other suitable clause, or any combination of suitable clauses, wherein the catalyst is a zeolite.
73. The method of clause 72, any other suitable clause, or any combination of suitable clauses, wherein the zeolite is metal-loaded or beta zeolite-based.
74. The method of clause 72, any other suitable clause, or any combination of suitable clauses, wherein the zeolite is selected from the group consisting of erionite, gmelinite, mordenite, ZSM-5, Cu/ZSM-5-MgO, and any combination thereof.
75. The method of clause 65, any other suitable clause, or any combination of suitable clauses, wherein the catalyst is montmorillonite.
76. The method of clause 1, any other suitable clause, or any combination of suitable clauses, wherein the cyclic compound of step iii) is a compound is selected from the group consisting of an aliphatic compound, an aromatic compound, a heterocyclic compound, a heteroaromatic compound, and any combination thereof.
77. The method of clause 1, any other suitable clause, or any combination of suitable clauses, wherein the cyclic compound of step iii) is an aliphatic compound.
78. The method of clause 77, any other suitable clause, or any combination of suitable clauses, wherein the aliphatic compound is selected from the group consisting of a cyclic C4-C10 alcohol, a cyclic C4-C10 ketone, or a cyclic C4-C10 acyl halide.
79. The method of clause 77, any other suitable clause, or any combination of suitable clauses, wherein the aliphatic compound is a cyclic C4-C10 alcohol.
80. The method of clause 79, any other suitable clause, or any combination of suitable clauses, wherein the cyclic C4-C10 alcohol is, cyclohexanol or cyclopentanol.
81. The method of clause 77, any other suitable clause, or any combination of suitable clauses, wherein the aliphatic compound is a cyclic C4-C10 ketone.
82. The method of clause 81, any other suitable clause, or any combination of suitable clauses, wherein the cyclic C4-C10 ketone is cyclohexanone or cyclopentanone.
83. The method of clause 1, any other suitable clause, or any combination of suitable clauses, wherein the cyclic compound of step iii) is an aromatic compound.
84. The method of clause 83, any other suitable clause, or any combination of suitable clauses, wherein the aromatic compound is a C5-C12 monocyclic or bicyclic compound.
85. The method of clause 83, any other suitable clause, or any combination of suitable clauses, wherein the aromatic compound is an aromatic amine, phenol, aldehyde, ketone, amide, diol, dione, acyl halide, or halide.
86. The method of clause 83, any other suitable clause, or any combination of suitable clauses, wherein the aromatic compound is a phenyl, biphenyl, phenol, anisole, guaiacol, aniline, catechol, naphthalene.
87. The method of clause 1, any other suitable clause, or any combination of suitable clauses, wherein the cyclic compound of step iii) is a heterocyclic compound.
88. The method of clause 87, any other suitable clause, or any combination of suitable clauses, wherein the heterocyclic compound is a cyclic C4-C10 with independently one or more heteroatoms of O, N, or S.
89. The method of clause 88, any other suitable clause, or any combination of suitable clauses, wherein the cyclic C4-C10 is a tetrahydrofuran, pyrrolidine, piperidine, tetrahydrothiophene, or morpholine.
90. The method of clause 1, any other suitable clause, or any combination of suitable clauses, wherein the cyclic compound of step iii) is a heteroaromatic compound.

91. The method of clause 90, any other suitable clause, or any combination of suitable clauses, wherein the heteroaromatic compound is a monocyclic or bicyclic C4-C12 with independently one or more heteroatoms of O, N, or S.
92. The method of clause 91, any other suitable clause, or any combination of suitable clauses, wherein the monocyclic or bicyclic C4-C12 is a furan, furfural, pyridine, thiophene, morpholine, quinoline.
93. The method of clause 1, any other suitable clause, or any combination of suitable clauses, wherein the coupled product mixture of step iii) comprises an ester.
94. The method of clause 1, any other suitable clause, or any combination of suitable clauses, wherein the coupled product mixture of step iii) comprises a ketone.
95. The method of clause 1, any other suitable clause, or any combination of suitable clauses, wherein the step of contacting the condensation product mixture with a cyclic compound is optionally performed multiple times.
96. The method of clause 95, any other suitable clause, or any combination of suitable clauses, wherein the step of contacting the condensation product mixture with a cyclic compound is optionally performed 2 times, 3 times, 4 times, 5 times, or 6 times.
97. The method of clause 95, any other suitable clause, or any combination of suitable clauses, wherein for each step of contacting, the cyclic compound is independently selected.
98. The method of clause 1, any other suitable clause, or any combination of suitable clauses, wherein the hydrogenating of step iv) comprises a hydrotreatment.
99. The method of clause 98, any other suitable clause, or any combination of suitable clauses, wherein the hydrotreatment comprises a hydro(deoxy)genation.
100. The method of clause 1, any other suitable clause, or any combination of suitable clauses, wherein the hydrogenating of step iv) is performed in the presence of a catalyst.
101. The method of clause 100, any other suitable clause, or any combination of suitable clauses, wherein the catalyst comprises one or more transition metal, one or more noble metal, or any combination thereof.
102. The method of clause 100, any other suitable clause, or any combination of suitable clauses, wherein the catalyst comprises a transition metal.
103. The method of clause 100, any other suitable clause, or any combination of suitable clauses, wherein the catalyst comprises a noble metal.
104. The method of clause 100, any other suitable clause, or any combination of suitable clauses, wherein the catalyst comprises a support.
105. The method of clause 104, any other suitable clause, or any combination of suitable clauses, wherein the support comprises a metal oxide or carbon.
106. The method of clause 100, any other suitable clause, or any combination of suitable clauses, wherein the catalyst is $Ni/Al_2O_3$, $CoMo/Al_2O_3$, $NiMo/Al_2O_3$, Ru/C, Pt/C, Pd/C, NiMo/C, or CoMo/C.
107. The method of clause 1, any other suitable clause, or any combination of suitable clauses, wherein the method further comprises a step of neutralizing the lubricant composition.
108. The method of clause 107, any other suitable clause, or any combination of suitable clauses, wherein the neutralizing step comprises adding an acid or a base.
109. The method of clause 108, any other suitable clause, or any combination of suitable clauses, wherein the acid is selected from the group consisting of hydrochloric acid, sulfuric acid, acetic acid, nitric acid, formic acid, and any combination thereof.
110. The method of clause 108, any other suitable clause, or any combination of suitable clauses, wherein the base is sodium hydroxide, potassium hydroxide, or a combination thereof.
111. A method of producing a lubricant composition, said method comprising the steps of
   i. reacting a starting material to provide a condensation product mixture,
   ii. contacting the condensation product mixture with a cyclic compound to provide a coupled product mixture, and
   iii. hydrogenating the coupled product mixture to provide the lubricant composition.
112. The method of clause 111, any other suitable clause, or any combination of suitable clauses, wherein the lubricant composition is a biolubricant.
113. The method of clause 112, any other suitable clause, or any combination of suitable clauses, wherein the biolubricant is produced from a non-synthetic starting material.
114. The method of clause 113, any other suitable clause, or any combination of suitable clauses, wherein the non-synthetic starting material is selected from the group consisting of a vegetable oil, an animal oil, and any combination thereof.
115. The method of clause 113, any other suitable clause, or any combination of suitable clauses, wherein the non-synthetic material is a vegetable oil.
116. The method of clause 113, any other suitable clause, or any combination of suitable clauses, wherein the non-synthetic material is an animal oil.
117. The method of clause 111, any other suitable clause, or any combination of suitable clauses, wherein the lubricant composition comprises a mixture of one or more lubricants.
118. The method of clause 117, any other suitable clause, or any combination of suitable clauses, wherein the lubricant comprises a mixture of one or more cyclic oxygenated hydrocarbons (COHCs).
119. The method of clause 111, any other suitable clause, or any combination of suitable clauses, wherein the starting material is a non-synthetic starting material.
120. The method of clause 111, any other suitable clause, or any combination of suitable clauses, wherein the starting material is an oil.
121. The method of clause 120, any other suitable clause, or any combination of suitable clauses, wherein the oil is a cooking oil.
122. The method of clause 121, any other suitable clause, or any combination of suitable clauses, wherein the cooking oil is selected from the group consisting of a vegetable oil, an animal oil, and any combination thereof.
123. The method of clause 121, any other suitable clause, or any combination of suitable clauses, wherein the cooking oil is a vegetable oil.
124. The method of clause 121, any other suitable clause, or any combination of suitable clauses, wherein the cooking oil is an animal oil.
125. The method of clause 120, any other suitable clause, or any combination of suitable clauses, wherein the oil is a waste cooking oil.

126. The method of clause 125, any other suitable clause, or any combination of suitable clauses, wherein the waste cooking oil is selected from the group consisting of a vegetable oil, animal oil, and combination thereof.
127. The method of clause 125, any other suitable clause, or any combination of suitable clauses, wherein the waste cooking oil is a vegetable oil.
128. The method of clause 125, any other suitable clause, or any combination of suitable clauses, wherein the waste cooking oil is an animal oil.
129. The method of clause 120, any other suitable clause, or any combination of suitable clauses, wherein the oil is a crude oil.
130. The method of clause 120, any other suitable clause, or any combination of suitable clauses, wherein the oil is a purified oil.
131. The method of clause 130, any other suitable clause, or any combination of suitable clauses, wherein the purified oil is provided by a filtration step, a water removal step, and a combination thereof.
132. The method of clause 130, any other suitable clause, or any combination of suitable clauses, wherein the purified oil is provided by a filtration step.
133. The method of clause 130, any other suitable clause, or any combination of suitable clauses, wherein the purified oil is provided by a water removal step.
134. The method of clause 111, any other suitable clause, or any combination of suitable clauses, wherein the starting material comprises a carboxylic acid.
135. The method of clause 134, any other suitable clause, or any combination of suitable clauses, wherein the carboxylic acid comprises one or more of a fatty acid.
136. The method of clause 135, any other suitable clause, or any combination of suitable clauses, wherein the one or more fatty acid comprises a C5 to C40 fatty acid.
137. The method of clause 111, any other suitable clause, or any combination of suitable clauses, wherein the starting material comprises one or more triglycerides, one or more fatty acids, and a combination thereof.
138. The method of clause 137, any other suitable clause, or any combination of suitable clauses, wherein the starting material comprises one or more triglycerides.
139. The method of clause 137, any other suitable clause, or any combination of suitable clauses, wherein the starting material comprises one or more fatty acids.
140. The method of clause 139, any other suitable clause, or any combination of suitable clauses, wherein the fatty acid comprises a C5 to C40 fatty acid.
141. The method of clause 111, any other suitable clause, or any combination of suitable clauses, wherein the reacting of step i) comprises a dehydration reaction.
142. The method of clause 111, any other suitable clause, or any combination of suitable clauses, wherein the reacting of step i) comprises a ketonization reaction.
143. The method of clause 111, any other suitable clause, or any combination of suitable clauses, wherein the reacting of step i) is performed in the presence of a catalyst.
144. The method of clause 143, any other suitable clause, or any combination of suitable clauses, wherein the catalyst is selected from the group consisting of an acid, a metal, a metal oxide, a zeolite, and any combination thereof.
145. The method of clause 143, any other suitable clause, or any combination of suitable clauses, wherein the catalyst is an acid.
146. The method of clause 145, any other suitable clause, or any combination of suitable clauses, wherein the acid is selected from the group comprising a formic acid, a sulfuric acid, a Lewis acid, an acid halide, and any combination thereof.
147. The method of clause 143, any other suitable clause, or any combination of suitable clauses, wherein the catalyst comprises a metal.
148. The method of clause 147, any other suitable clause, or any combination of suitable clauses, wherein the metal comprises cobalt.
149. The method of clause 147, any other suitable clause, or any combination of suitable clauses, wherein the metal comprises nickel.
150. The method of clause 143, any other suitable clause, or any combination of suitable clauses, wherein the catalyst is a metal oxide.
151. The method of clause 150, any other suitable clause, or any combination of suitable clauses, wherein the metal oxide is selected from the group consisting of $ZrO_2$, $ZrO_2/H_2SO_4$, $Fe_3O_4$, $TiO_2$, $B_2O_3$, $WO_3$, PbO, MgO, CoO, $Al_2O_3$, $SiO_2$, $SiO_2/Al_2O_3$, and any combination thereof.
152. The method of clause 143, any other suitable clause, or any combination of suitable clauses, wherein the catalyst is a zeolite.
153. The method of clause 152, any other suitable clause, or any combination of suitable clauses, wherein the zeolite is erionite, gmelinite, mordenite, or ZSM-5.
154. The method of clause 143, any other suitable clause, or any combination of suitable clauses, wherein the catalyst is montmorillonite.
155. The method of clause 111, any other suitable clause, or any combination of suitable clauses, wherein the dehydrated product mixture of step i) comprises an anhydride, a ketone, an ether, an acyl halide, an arene, and any combination thereof.
156. The method of clause 111, any other suitable clause, or any combination of suitable clauses, wherein the dehydrated product mixture of step i) comprises an anhydride.
157. The method of clause 111, any other suitable clause, or any combination of suitable clauses, wherein the dehydrated product mixture of step i) comprises a ketone.
158. The method of clause 111, any other suitable clause, or any combination of suitable clauses, wherein the dehydrated product mixture of step i) comprises an ether.
159. The method of clause 111, any other suitable clause, or any combination of suitable clauses, wherein the dehydrated product mixture of step i) comprises an acyl halide.
160. The method of clause 111, any other suitable clause, or any combination of suitable clauses, wherein the dehydrated product mixture of step i) comprises an arene.
161. The method of clause 111, any other suitable clause, or any combination of suitable clauses, wherein the contacting of step ii) comprises an alkylation reaction, an acylation reaction, an esterification reaction, or an etherification reaction.
162. The method of clause 111, any other suitable clause, or any combination of suitable clauses, wherein the contacting of step ii) is performed in the presence of a catalyst.

163. The method of clause 162, any other suitable clause, or any combination of suitable clauses, wherein the catalyst is selected from the group consisting of an acid, a metal, a metal oxide, a zeolite, and any combination thereof.

164. The method of clause 162, any other suitable clause, or any combination of suitable clauses, wherein the catalyst is an acid.

165. The method of clause 164, any other suitable clause, or any combination of suitable clauses, wherein the acid is a Lewis acid.

166. The method of clause 165, any other suitable clause, or any combination of suitable clauses, wherein the Lewis acid is $AlCl_3$ or $FeCl_3$.

167. The method of clause 162, any other suitable clause, or any combination of suitable clauses, wherein the catalyst comprises a metal.

168. The method of clause 162, any other suitable clause, or any combination of suitable clauses, wherein the catalyst is a metal oxide.

169. The method of clause 168, any other suitable clause, or any combination of suitable clauses, wherein the metal oxide is selected from the group consisting of $ZrO_2$, $Fe_3O_4$, $TiO_2$, $B_2O_3$, $WO_3$, PbO, MgO, CoO, $Al_2O_3$, $SiO_2$, $SiO_2$—$Al_2O_3$, and any combination thereof.

170. The method of clause 162, any other suitable clause, or any combination of suitable clauses, wherein the catalyst is a zeolite.

171. The method of clause 170, any other suitable clause, or any combination of suitable clauses, wherein the zeolite is metal-loaded or beta zeolite-based.

172. The method of clause 170, any other suitable clause, or any combination of suitable clauses, wherein the zeolite is selected from the group consisting of erionite, gmelinite, mordenite, ZSM-5, Cu/ZSM-5-MgO, and any combination thereof.

173. The method of clause 162, any other suitable clause, or any combination of suitable clauses, wherein the catalyst is montmorillonite.

174. The method of clause 111, any other suitable clause, or any combination of suitable clauses, wherein the cyclic compound of step ii) is selected from the group consisting of an aliphatic compound, an aromatic compound, a heterocyclic compound, a heteroaromatic compound, and any combination thereof.

175. The method of clause 111, any other suitable clause, or any combination of suitable clauses, wherein the cyclic compound of step ii) is an aliphatic compound.

176. The method of clause 175, any other suitable clause, or any combination of suitable clauses, wherein the aliphatic compound is selected from the group consisting of a cyclic C4-C10 alcohol, a cyclic C4-C10 ketone, or a cyclic C4-C10 acyl halide.

177. The method of clause 175, any other suitable clause, or any combination of suitable clauses, wherein the aliphatic compound is a cyclic C4-C10 alcohol.

178. The method of clause 177, any other suitable clause, or any combination of suitable clauses, wherein the cyclic C4-C10 alcohol is cyclohexanol or cyclopentanol.

179. The method of clause 175, any other suitable clause, or any combination of suitable clauses, wherein the aliphatic compound is a cyclic C4-C10 ketone.

180. The method of clause 179, any other suitable clause, or any combination of suitable clauses, wherein the cyclic C4-C10 ketone is cyclohexanone or cyclopentanone.

181. The method of clause 111, any other suitable clause, or any combination of suitable clauses, wherein the cyclic compound of step ii) is an aromatic compound.

182. The method of clause 181, any other suitable clause, or any combination of suitable clauses, wherein the aromatic compound is a C5-C12 monocyclic or bicyclic compound.

183. The method of clause 181, any other suitable clause, or any combination of suitable clauses, wherein the aromatic compound comprises an aromatic amine, phenol, aldehyde, ketone, amide, diol, dione, acyl halide, or halide.

184. The method of clause 181, any other suitable clause, or any combination of suitable clauses, wherein the aromatic compound comprises a phenyl, biphenyl, phenol, anisole, guaiacol, aniline, catechol, naphthalene.

185. The method of clause 111, any other suitable clause, or any combination of suitable clauses, wherein the cyclic compound of step ii) is a heterocyclic compound.

186. The method of clause 185, any other suitable clause, or any combination of suitable clauses, wherein the heterocyclic compound is a cyclic C4-C10 with independently one or more heteroatoms of O, N, or S.

187. The method of clause 186, any other suitable clause, or any combination of suitable clauses, wherein the cyclic C4-C10 comprises a tetrahydrofuran, pyrrolidine, piperidine, tetrahydrothiophene, or morpholine.

188. The method of clause 111, any other suitable clause, or any combination of suitable clauses, wherein the cyclic compound of step ii) comprises a heteroaromatic compound.

189. The method of clause 188, any other suitable clause, or any combination of suitable clauses, wherein the heteroaromatic compound is a monocyclic or bicyclic C4-C12 with independently one or more heteroatoms of O, N, or S.

190. The method of clause 188, any other suitable clause, or any combination of suitable clauses, wherein the heteroaromatic compound comprises a furan, furfural, pyridine, thiophene, morpholine, quinoline.

191. The method of clause 111, any other suitable clause, or any combination of suitable clauses, wherein the coupled product mixture of step ii) comprises an ester.

192. The method of clause 111, any other suitable clause, or any combination of suitable clauses, wherein the coupled product mixture of step ii) comprises a ketone.

193. The method of clause 111, any other suitable clause, or any combination of suitable clauses, wherein the step of contacting the condensation product mixture with a cyclic compound is optionally performed multiple times.

194. The method of clause 193, any other suitable clause, or any combination of suitable clauses, wherein the step of contacting the condensation product mixture with a cyclic compound is optionally performed 2 times, 3 times, 4 times, 5 times, or 6 times.

195. The method of clause 193, any other suitable clause, or any combination of suitable clauses, wherein for each step of contacting, the cyclic compound is independently selected.

196. The method of clause 111, any other suitable clause, or any combination of suitable clauses, wherein the hydrogenating of step iii) comprises a hydrotreatment.
197. The method of clause 196, any other suitable clause, or any combination of suitable clauses, wherein the hydrotreatment comprises a hydro(deoxy)genation.
198. The method of clause 111, any other suitable clause, or any combination of suitable clauses, wherein the hydrogenating of step iii) is performed in the presence of a catalyst.
199. The method of clause 198, any other suitable clause, or any combination of suitable clauses, wherein the catalyst comprises one or more transition metal, one or more noble metal, or any combination thereof.
200. The method of clause 198, any other suitable clause, or any combination of suitable clauses, wherein the catalyst comprises a transition metal.
201. The method of clause 198, any other suitable clause, or any combination of suitable clauses, wherein the catalyst comprises a noble metal.
202. The method of clause 198, any other suitable clause, or any combination of suitable clauses, wherein the catalyst comprises a support.
203. The method of clause 198, any other suitable clause, or any combination of suitable clauses, wherein the support comprises a metal oxide or carbon.
204. The method of clause 198, any other suitable clause, or any combination of suitable clauses, wherein the catalyst is $Ni/Al_2O_3$, $CoMo/Al_2O_3$, $NiMo/Al_2O_3$, Ru/C, Pt/C, Pd/C, NiMo/C, or CoMo/C.
205. The method of clause 111, any other suitable clause, or any combination of suitable clauses, wherein the method further comprises a step of neutralizing the lubricant composition.
206. The method of clause 205, any other suitable clause, or any combination of suitable clauses, wherein the neutralizing step comprises adding an acid or a base.
207. The method of clause 206, any other suitable clause, or any combination of suitable clauses, wherein the acid is selected from the group consisting of hydrochloric acid, sulfuric acid, acetic acid, nitric acid, formic acid, and any combination thereof.
208. The method of clause 206, any other suitable clause, or any combination of suitable clauses, wherein the base is sodium hydroxide, potassium hydroxide, or a combination thereof.
209. A lubricant composition produced according to the method of claim 1 or claim 2.
210. The lubricant composition of clause 209, any other suitable clause, or any combination of suitable clauses, wherein the composition comprises an additive.
211. The lubricant composition of clause 210, any other suitable clause, or any combination of suitable clauses, wherein the additive is selected from the group consisting of a surface protective additive, a performance additive, a lubricant protective additive, and any combination thereof.
212. The lubricant composition of clause 210, any other suitable clause, or any combination of suitable clauses, wherein the additive comprises a surface protective additive.
213. The lubricant composition of clause 212, any other suitable clause, or any combination of suitable clauses, wherein the surface protective additive is selected from the group consisting of an anti-wear agent, a corrosion and rust inhibitor, a detergent, a dispersant, a friction modifier, and any combination thereof.
214. The lubricant composition of clause 212, any other suitable clause, or any combination of suitable clauses, wherein the surface protective additive is an anti-wear agent.
215. The lubricant composition of clause 214, any other suitable clause, or any combination of suitable clauses, wherein the anti-wear agent comprises one or more of a zinc dithiophosphate, an organic phosphate, an acid phosphate, an organic sulfur, a chlorine compound, a sulfurized fat, a sulfide, and a disulfide.
216. The lubricant composition of clause 212, any other suitable clause, or any combination of suitable clauses, wherein the surface protective additive is a corrosion and rust inhibitor.
217. The lubricant composition of clause 216, any other suitable clause, or any combination of suitable clauses, wherein the corrosion and rust inhibitor comprises one or more of a zinc dithiophosphate, a metal phenolate, a basic metal sulfonate, a fatty acid, and an amine
218. The lubricant composition of clause 212, any other suitable clause, or any combination of suitable clauses, wherein the surface protective additive is a detergent.
219. The lubricant composition of clause 218, any other suitable clause, or any combination of suitable clauses, wherein the detergent comprises one or more metallo-organic compounds.
220. The lubricant composition of clause 219, any other suitable clause, or any combination of suitable clauses, wherein the metallo-organic compound is selected from the group consisting of barium, calcium phenolate, magnesium phenolate, phosphate, and sulfonate.
221. The lubricant composition of clause 212, any other suitable clause, or any combination of suitable clauses, wherein the surface protective additive is a dispersant.
222. The lubricant composition of clause 221, any other suitable clause, or any combination of suitable clauses, wherein the dispersant comprises one or more of a polymeric alkylthiophosphonate, an alkylsuccinimide, and an organic complex containing nitrogen.
223. The lubricant composition of clause 212, any other suitable clause, or any combination of suitable clauses, wherein the surface protective additive is a friction modifier.
224. The lubricant composition of clause 223, any other suitable clause, or any combination of suitable clauses, wherein the friction modifier comprises one or more of an organic fatty acid, an amine, a lard oil, a high molecular weight organic phosphorus, and phosphoric acid ester.
225. The lubricant composition of clause 210, any other suitable clause, or any combination of suitable clauses, wherein the additive comprises a performance additive.
226. The lubricant composition of clause 225, any other suitable clause, or any combination of suitable clauses, wherein the performance additive is selected from the group consisting of a pour point depressant, a seal swell agent, a viscosity improver, and any combination thereof.
227. The lubricant composition of clause 225, any other suitable clause, or any combination of suitable clauses, wherein the performance additive is a pour point depressant.
228. The lubricant composition of clause 227, any other suitable clause, or any combination of suitable clauses, wherein the pour point depressant comprises one or more of an alkylated naphthalene, a phenolic polymer, and a polymethacrylate.

229. The lubricant composition of clause 225, any other suitable clause, or any combination of suitable clauses, wherein the performance additive is a seal swell agent.
230. The lubricant composition of clause 229, any other suitable clause, or any combination of suitable clauses, wherein the seal swell agent comprises one or more of an organic phosphate, an aromatic, and a halogenated hydrocarbon.
231. The lubricant composition of clause 225, any other suitable clause, or any combination of suitable clauses, wherein the performance additive is a viscosity additive.
232. The lubricant composition of clause 231, any other suitable clause, or any combination of suitable clauses, wherein the viscosity additive comprises one or more of a polymer of methacrylate, a copolymer of methacrylate, a butadiene olefin, and an alkylated styrene.
233. The lubricant composition of clause 210, any other suitable clause, or any combination of suitable clauses, wherein the additive comprises a lubricant protective additive.
234. The lubricant composition of clause 233, any other suitable clause, or any combination of suitable clauses, wherein the lubricant protective additive is selected from the group consisting of an anti-foaming agent, an antioxidant, a metal deactivator, and any combination thereof.
235. The lubricant composition of clause 233, any other suitable clause, or any combination of suitable clauses, wherein the lubricant protective additive is an anti-foaming agent.
236. The lubricant composition of clause 235, any other suitable clause, or any combination of suitable clauses, wherein the anti-foaming agent comprises a silicone polymer, an organic copolymer, or a combination thereof.
237. The lubricant composition of clause 233, any other suitable clause, or any combination of suitable clauses, wherein the lubricant protective additive is an antioxidant.
238. The lubricant composition of clause 237, any other suitable clause, or any combination of suitable clauses, wherein the antioxidant comprises one or more of a zinc dithiophosphate, a hindered phenol, an aromatic amine, and a sulfurized phenol.
239. The lubricant composition of clause 233, any other suitable clause, or any combination of suitable clauses, wherein the lubricant protective additive is a metal deactivator.
240. The lubricant composition of clause 239, any other suitable clause, or any combination of suitable clauses, wherein the metal deactivator comprises one or more of an organic complex containing nitrogen or a sulfur, an amine, a sulfide, and a phosphite.

The use of the term "or" in the claims is used to mean "and/or" unless explicitly indicated to refer to alternatives only or the alternatives are mutually exclusive, although the disclosure supports a definition that refers to only alternatives and "and/or."

As used in this specification and claim(s), the words "comprising" (and any form of comprising, such as "comprise" and "comprises"), "having" (and any form of having, such as "have" and "has"), "including" (and any form of including, such as "includes" and "include") or "containing" (and any form of containing, such as "contains" and "contain") are inclusive or open-ended and do not exclude additional, unrecited elements or method steps.

EXAMPLE 1

Exemplary Experimental Procedures

The instant example provides exemplary materials and methods utilized in Examples 2-4 as described herein. In addition, the examples and description of Jahromi et al., "Synthesis of Novel Biolubricants from Waste Cooking Oil and Cyclic Oxygenates through an Integrated Catalytic Process," *ACS Sustainable Chem. Eng.,* 2021; 9:13424-13437 is incorporated by reference herein in its entirety.

In the present disclosure, a four-step catalytic pathway to produce BLs from waste cooking oil and cyclic oxygenated hydrocarbons (COHCs) using integrated catalytic processes was established. These steps include 1) hydrolysis, 2) dehydration/ketonization, 3) Friedel-Crafts (FC) acylation/alkylation, and 4) mild hydro(deoxy)genation (FIG. 1).

Materials. Oleic acid ($90^{+}$%), stearic acid ($90^{+}$%), mineral oil (white paraffin oil), cyclopentanone (CPN) (99%), cyclopentanol (CPL) (99%), anisole (ASL) (99%), anhydrous sodium sulfate, and ZSM-5, were purchased from Alfa Aesar (Haverhill, MA, USA) and used as received throughout the experiments. 2-methylfuran (2-MF), magnesium nitrate hexahydrate ($Mg(NO_3)_2.6H_2O$), and $Ni/SiO_2$—$Al_2O_3$ catalyst were obtained from Sigma-Aldrich (St. Louis, MO., USA). Iron (II, III) oxide (97%) (magnetite) and copper nitrate trihydrate ($Cu(NO_3)\cdot 3H_2O$) were purchased from BeanTown Chemical (Hudson, N.H., USA) and (Ward's Scince, ON, Canada), respectively. Waste cooking oil (WCO) from canola oil was procured from household cooking. Noack reference oil SNC-150 was bought from Tannas Co. (Midland, MI, USA). In addition, three different commercial engine oils with different brands, including OW-20 (Mobil), 10W-40 (Valvoline), 15W-40 (Shell), were purchased for comparative characterization studies. Methanol, and potassium hydroxide (KOH) pellets were obtained from VWR chemicals (USA), while hydrochloric acid (HCl) was purchased from Macron Fine chemicals (USA).

Catalysis. Hydrolysis of waste cooking oil (WCO) was performed using 0.1 M sulfuric acid in deionized water at subcritical condition (250° C., 400 psi $N_2$ cold pressure, 25% water loading). Magnetite (iron (II,III) oxide), which is known to catalyze dehydration/ketonization reaction effectively, was used as received for pre-processing of fatty acids and hydrolyzed WCO under inert atmosphere (350 psi $N_2$). For the FC acylation/alkylation step, a Cu/ZSM5-MgO catalyst was prepared using wet impregnation method. Briefly, calculated amount of $Mg(NO_3)_2.6H_2O$ solution was added dropwise to a slurry solution of ZSM-5 (in DI water). The mixture was stirred continuously while heated to about 90° C. until a thick paste was formed. This paste was dried at 105° C. for six hours and then calcined at 575° C. for another six hours. The calcined ZSM5-MgO that contained approximately 10% MgO was used as catalyst support by doping with $Cu(NO_3)\cdot 3H_2O$ solution (in DI water) via wet impregnation similar to support preparation. The catalyst precursor that contained approximately 5% Cu (dry-basis) was calcined at 575° C., and reduced in-situ (using 10% $H_2$ in $N_2$ at 400° C.) prior to FC acylation/alkylation reaction. $Ni/SiO_2$—$Al_2O_3$ was used as hydro(deoxy)genation catalyst without any pre-processing and activation.

Brunauer-Emmett-Teller (BET) specific surface area of the catalyst samples were evaluated from $N_2$-adsorption-desorption isotherm, which was carried out at 77 K by liquid $N_2$ using the surface area analyzer (Autosorb-iQ, Quantchrome Instruments, USA). Initially, the samples were outgassed at 80° C. for 1 h, followed by 150° C. for 6 hours under vacuum (10-6 bar). The multipoint BET equation was used to calculate the specific surface area of the samples. The average pore size of catalysts was also measured during the BET analysis. The catalyst samples were characterized by CuKα radiation (λ=1.5418 Å) using a bench-top powder X-ray diffraction (XRD) system (AXRD, Proto manufacturing, MI, USA) from 20° to 100° (2θ) with 2 seconds of dwell time and 0.014° of Δ2θ at 30 mA and 40 kV.

Synthesis of bio-lubricants. All pressure experiments were performed using a 100 mL Parr 4598 bench-top reactor outfitted with a pressure gauge, thermocouple, adjustable stirrer, heating mantle, and Parr 4848 reactor controller. Two series of FFA model compound experiments as well as two series of WCO experiments were carried out for BL synthesis in this work. Oleic acid (after dehydration/ketonization) was selected to react with CPN while stearic acid (after dehydration/ketonization) was reacted with an equimolar mixture of ASL and 2-MF. WCO, once underwent hydrolysis and dehydration/ketonization, was reacted with ASL in one set of experiments, and with equimolar ASL/CPL/2-MF mixture in another set of experiments. The selected cyclic oxygenates (2-MF, ASL, CPN, and CPL) can be sourced from lignocellulosic biomass, alternatively. Hydrolysis of WCO was performed under 400 psi $N_2$ at 250° C. with oil-to-water mass ratio of 3:1, typically 30 g WCO and 10 g DI water. Dehydration/ketonization reactions were carried out using magnetite as a catalyst under 350 psi cold $N_2$ pressure and feed-to-catalyst ratio of 35 to 1. After each experiment, the liquid products were collected in centrifuge test tubes and centrifuged (using a DYNAC centrifuge, Clay Adams, Parsippany, N.J., USA) for 10 minutes at g-force of 2147 to separate the resulting oil and residual solids and catalyst. Dehydration/ketonization product mixture was then transferred to the Parr reactor. Selected COHC compound (or equimolar mixture of COHCs) was added to the reactor to as limiting reactant(s) to minimize self-condensation to achieve 15 wt. % of the total liquid fed. To this mixture, Cu/ZSM5-MgO catalyst (feed-to-catalyst mass ratio of 30 to 1) was added and then the reactor was closed and pressurized to 350 psi with nitrogen to ensure liquid-phase reaction. In addition, the pH of feed mixture was adjusted to 4.5-5.5 using a 510 Series Oakton pH meter (Thermo Fisher Scientific, Waltham, MA, USA) by adding 0.1M sulfuric acid. FC acylation/alkylation reaction was allowed to take place at 80° C. (slow heating rate, approximately 5° C./min) for 3 hours. The reactor was then cooled to room temperature, and liquid products were separated by centrifugation. Mild hydrotreatment was then performed at 200 psi using 10% $H_2$ (balance nitrogen) in the presence of $Ni/SiO_2$—$Al_2O_3$ catalyst. The reactor pressure change was monitored as an indication of reaction completion until no hydrogen consumption (pressure drop) was observed. Then the reactor was cooled, and liquid products were separated using centrifugation. To neutralize unreacted compounds (such as FFAs) that contribute to total acid number (TAN), the BL was neutralized using 0.1M KOH, and then subjected to rotary evaporation (under approximately 650 mmHg vacuum) at 95° C. to remove water and low-molecular-weight volatiles. A summary of the step-wise experimental matrix used in this work is presented in Table 1.

TABLE 1

Experimental matrix for the production of bio-lubricants from model compounds and WCO.

| | Exp. # | Reactant(s) | Treatment | Atm. ($P_{i,\,psi}$) | Catalyst | T (° C.) | Product label |
|---|---|---|---|---|---|---|---|
| Model compounds | 1 | Oleic acid | Dehydration/ ketonization | $N_2$ (350) | $Fe_3O_4$ | 350 | P1 |
| | 2 | P1/CPN | FC acylation/ alkylation | $N_2$ (350) | Cu/ZSM5-MgO | 80 | P2 |
| | 3 | P2 | HDO | 10% $H_2$ (200) | $Ni/SiO_2$—$Al_2O_3$ | 230 | P3 |
| | 4 | P3 | Neutralization | Air (14.7) | 0.1M KOH | 40 | P4 |
| | 5 | P4 | Distillation | Vacuum | NA | 95 | P5 |
| | 6 | Stearic acid | Dehydration/ ketonization | $N_2$ (350) | $Fe_3O_4$ | 350 | P6 |
| | 7 | P6/ASL/ 2-MF | FC acylation/ alkylation | $N_2$ (350) | Cu/ZSM5-MgO | 80 | P7 |
| | 8 | P7 | HDO | 10% $H_2$ (200) | $Ni/SiO_2$—$Al_2O_3$ | 230 | P8 |
| | 9 | P8 | Neutralization | Air (14.7) | 0.1M KOH | 40 | P9 |
| | 10 | P9 | Distillation | Vacuum | NA | 95 | P10 |
| Real WCO | 11 | WCO | Hydrolysis | $N_2$ (400) | Water | 250 | P11 |
| | 12 | P11 | Dehydration/ ketonization | $N_2$ (350) | $Fe_3O_4$ | 350 | P12 |
| | 13 | P12/ASL | FC acylation/ alkylation | $N_2$ (350) | Cu/ZSM5-MgO | 80 | P13 |
| | 14 | P13 | HDO | 10% $H_2$ (200) | $Ni/SiO_2$—$Al_2O_3$ | 250 | P14 |
| | 15 | P14 | Neutralization | Air (14.7) | 0.1M KOH | 40 | P15 |
| | 16 | P15 | Distillation | Vacuum | NA | 95 | P16 |
| | 18 | P12/ASL/ 2-MF/CPL | FC acylation/ alkylation | $N_2$ (350) | Cu/ZSM5-MgO | 80 | P17 |
| | 19 | P18 | HDO | 10% $H_2$ (200) | $Ni/SiO_2$—$Al_2O_3$ | 250 | P18 |
| | 20 | P19 | Neutralization | Air (14.7) | 0.1M KOH | 40 | P19 |
| | 21 | P20 | Distillation | Vacuum | NA | 95 | P20 |

Physicochemical characterization. Fatty acid profile of waste cooking oil (WCO) was determined via traditional saponification and transesterification reaction with methanol. A solution of 0.5 M methanolic KOH was prepared by dissolving 2.8 g KOH pellets into 100 ml methanol. Methanolic HCl solution was then prepared at 4:1 HCl-to-methanol volumetric ratio (i.e. 5 ml methanol was added to 20 ml concentrated HCl). 400 μl WCO was then introduced into a round-bottom flask that was submerged in water bath at 85° C. To the WCO, 8 ml of 0.5 M methanolic KOH was added, and a reflux condenser was installed to circulate the vapors back to the flask. After 15 minutes, the flask was cooled to room temperature and 3.2 ml methanolic HCl was added to the flask and heated at 85° C. for another 30 minutes. Fatty acid methyl esters (FAME) were then extracted by adding 16 ml DI water and 12 ml n-hexane to the flask. Then the liquids were transferred to a separatory funnel to remove the top layer that contained n-hexane and FAMEs. Hexane extraction was repeated three times, and then the extracts were passed through anhydrous sodium sulfate bed and filtered (0.2 μm Teflon filter). Finally, the extracts were analyzed using GC-MS as described below (also refer to supporting information).

Thermal decomposition and stability of produced BLs and commercial engine oils were evaluated using a Shimadzu TGA-50 (Shimadzu, Japan) under nitrogen atmosphere with heating rate of 10° C./min from room temperature up to 700° C. Noack volatility studies of synthesized bio-lubricants was carried out according to ASTM D6375 using thermogravimetric method on the same Shimadzu TGA-50 (Shimadzu, Japan) that was calibrated using SNC-150 Noack reference oil. The total acid number (TAN) of BL samples was determined through a titration according to ASTM D664-07 using a Mettler Toledo T50 Titrator (Columbus, OH, USA). The kinematic viscosities at 40 and 100° C. ($KV_{40}$ and $KV_{100}$), and viscosity index (VI) of the samples were measured using a viscometer (SVM 3001, Anton Paar, Austria). The VI was determined according to ASTM D2270, while $KV_{40}$ and $KV_{100}$ were determined according to ASTM D445. Pour point measurement was conducted following ASTM D97 method. The chemical composition of bio-lubricants was analyzed using an Agilent Technologies 7890A Gas Chromatograph (GC) System outfitted with a 7683B Series Injector and 5975C Inert Mass Selective Detector (MSD) with Triple-Axis Detector. The GC-MS was equipped with 30 m×250 μm×0.25 μm DB-1701 Column. An estimated 20 mg of each sample into a clean vial and diluting each sample with dichloromethane (DCM) until each diluted sample contained nearly 2 wt. % BL. The filled vial was then loaded into an auto sampler and injected using a 10 μL syringe into the GC System. The GC oven was programmed to heat to an initial temperature of 50° C. and hold for 2 minutes before being heated at a heating rate of 5° C./min to a final temperature of 280° C. and holding time of 15 minutes, unless specified otherwise. All chemical structures presented in this work are obtained from NIST (National Institute of Standards and Technology) MS Library paired with the GC-MS operating software. All suggested chemical structures from the MS software were carefully evaluated and the most possible products that could form from each reaction were presented.

EXAMPLE 2

Catalyst Characterization

In the instant example, FIG. 2A shows the peaks position of the diffractogram corresponding to the phase identified according to the cubic spatial group Fd-3 m of magnetite that was in good agreement with the literature. The BET specific surface area was found, and an average pore size of 33 $m^2/g$ and 17.3 Å, respectively, for the magnetite catalyst (Table 2). Regarding the HDO catalyst, full characterization of $Ni/SiO_2$—$Al_2O_3$ is reported elsewhere. The diffraction peak characteristics of the parent ZSM-5 were observed at 2θ=22.96°, 23.82°, 24.32°, 45.8°, and 64.3° (FIG. 2B), which is in accordance with the previously reported ZSM-5 structure. The crystalline structure of the ZSM-5, however, did not remain constant after loading with MgO and copper, and calcinations at 575° C. The Cu/ZSM5-MgO precursors (calcined form) showed MgO and CuO diffraction peaks as shown in FIG. 2C. The presence of crystalline Cu was confirmed by XRD diffraction peaks at 44.31°, 47.63°, and 74.27° after catalyst activation by reduction (FIG. 2D). The identification of XRD peaks were labelled according to the Joint Committee on Power Diffraction Standards (JCPDS) file No. 2-1040. It was also observed that the ZSM5 peak at 22.96° did not change after catalyst reduction. BET specific surface area and average pore sizes of the catalysts used in this work are presented in Table 2. The BET specific surface area of magnetite was relatively lower than supported catalysts and was attributed to higher surface area of metal oxides in the supported catalysts. Modification of ZSM5 with CuO and MgO had a significant impact on reduction of BET surface are from 477 to 177 $m^2/g$, whereas the average pore size increased from 9.6 Å to 11.4 Å. Without being bound by any theory, this could suggest that CuO and MgO penetrated through the amorphous structure in the modified catalyst creating a catalyst matrix with more macropores than mesopores. Additionally, it was found that an increase in BET specific surface area resulted in an increase in pore volume (that can be an indication of catalyst porosity), whereas a linear relationship between BET specific surface areas did not exist.

TABLE 2

BET specific surface area and average pore size analysis of heterogeneous catalysts.

| Catalyst | $S_{BET}$ ($m^2/g$) | $D_{avg.}$ (Å) | PV ($cm^3/g$) |
|---|---|---|---|
| Magnetite | 33 | 17.3 | 0.055 |
| ZSM5 | 477 | 9.6 | 0.870 |
| Cu/ZSM5—MgO | 177 | 11.4 | 0.323 |
| $Ni/Si_2O$—$Al_2O_3$ | 159 | 33.1 | 0.264 |

EXAMPLE 3

Chemical Characterization of Bio-Lubricants

Figure 3:
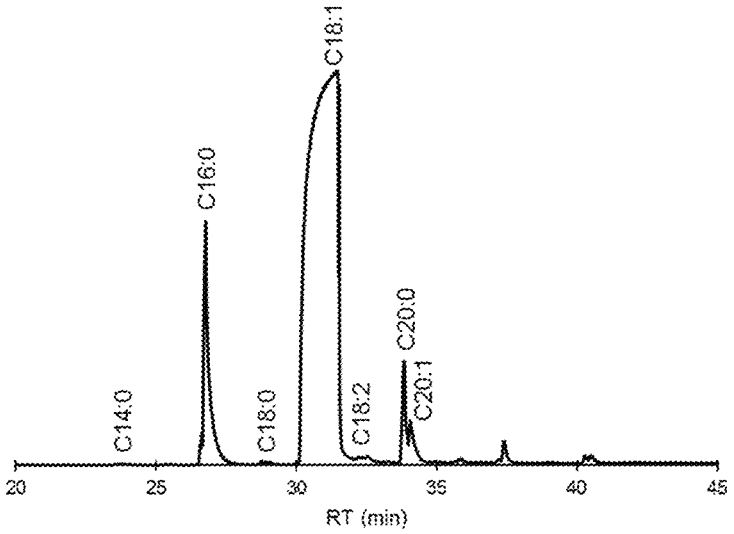
FIG. 3 shows the fatty acid profile of waste cooking oil.
Figure 14:
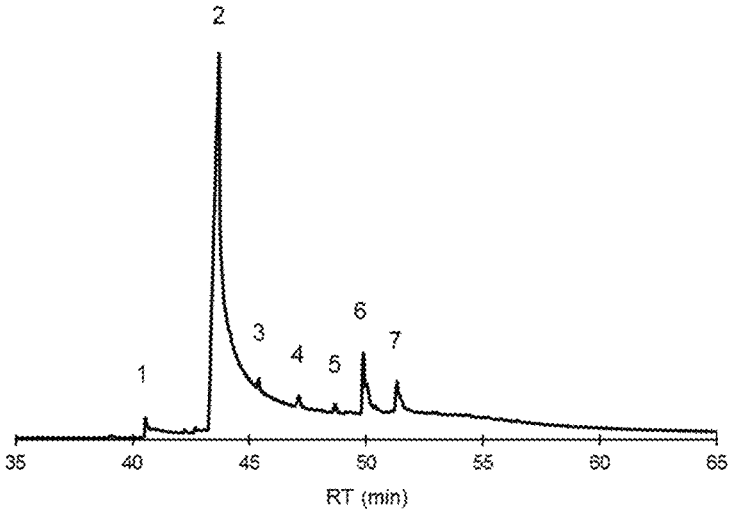
FIG. 14 shows GC-MS chromatogram of P11.
Figure 15:
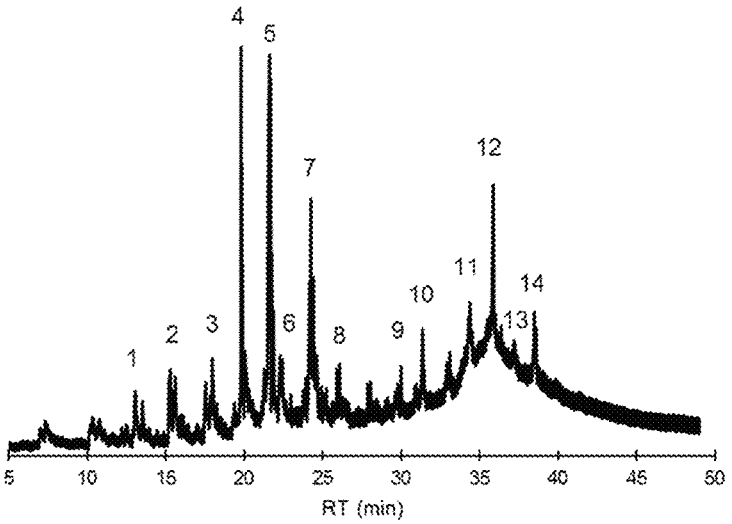
FIG. 15 shows GC-MS chromatogram of P12.
Figure 16:
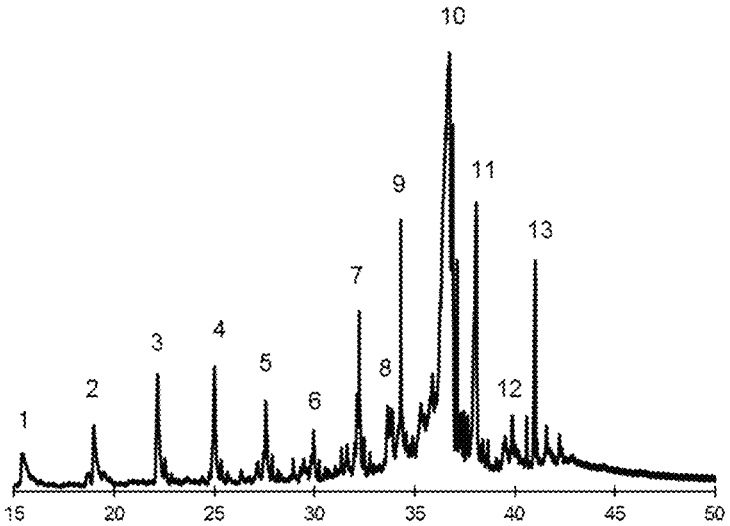
FIG. 16 shows GC-MS chromatogram of P13.
Figure 17:
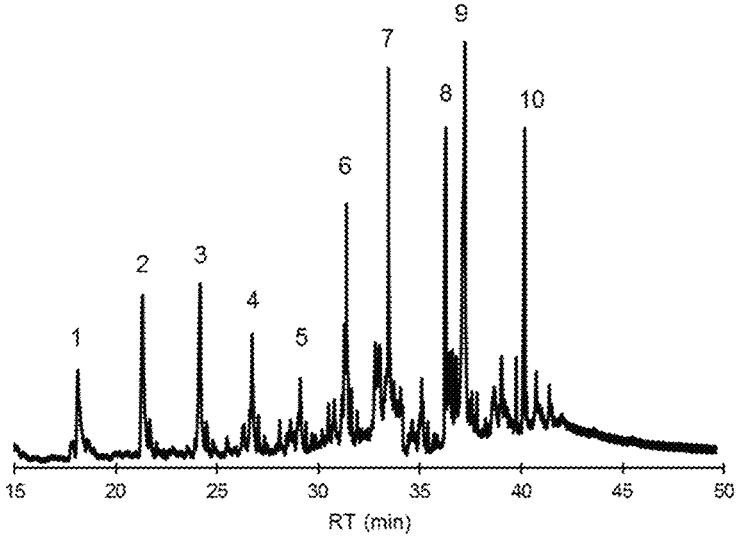
FIG. 17 shows GC-MS chromatogram of P14.
Figure 18:
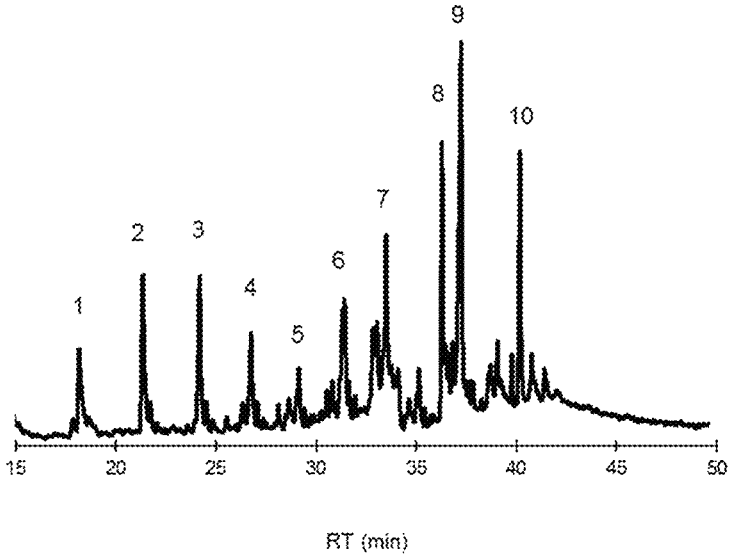
FIG. 18 shows GC-MS chromatogram of P15.
Figure 19:
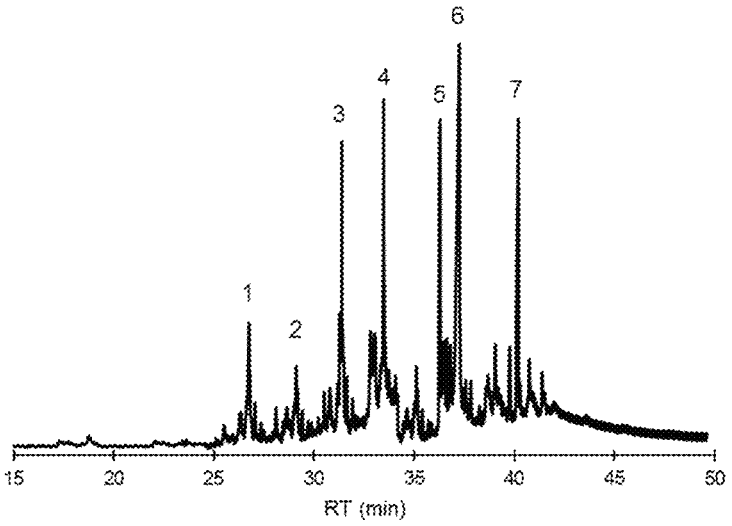
FIG. 19 shows GC-MS chromatogram of P16.

In the instant example, the GC-MS chromatogram and fatty acid profile of WCO are presented in FIG. 3 and Table 3, respectively. As expected, oleic acid and palmitic acid were the major fatty acids present in the WCO at 63.2 wt. % and 18.6 wt. %, respectively. Major GC-MS peaks were carefully evaluated for possible products with respect to parent reactants. GC-MS chromatograms and identified chemical structures of all intermediate products (P1-P20) are presented in FIGS. 4-23 and Tables 4-23. Unlike WCO experiments (Exp. 11-21), model fatty acid experiments (Exp.1-10) did not include the hydrolysis step, because the goal of hydrolysis reaction was to produce fatty acids from WCO. The major product of WCO hydrolysis was oleic acid, followed by 9,17-octadecadienal and 8-(2-octylcyclopropyl)octanal. In addition, some other C18-derivatives were identified as shown in FIG. 14 and Table 14. In general, the dehydration/ketonization step produced carboxylic acid-derived anhydrides and ketones as main products. Additionally, some hydrogen was produced during the reaction that may explain the presence of more C=C bonds in the final product. While anhydrides are key to Friedel Crafts acylation, the formation of C=C bonds and C=O bonds also contributed to the next alkylation step. Dehydration and ketonization reactions are reported to take place via reactions (1) and (2), respectively, producing longer chain hydrocarbon precursors.

(1)

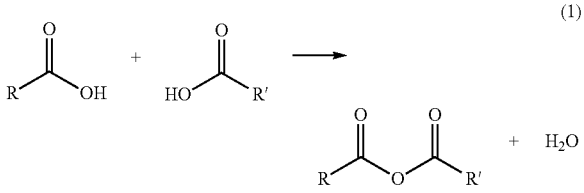

(2)

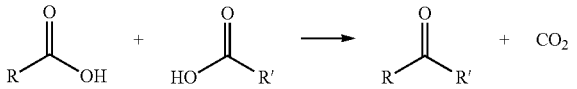

Figure 4:
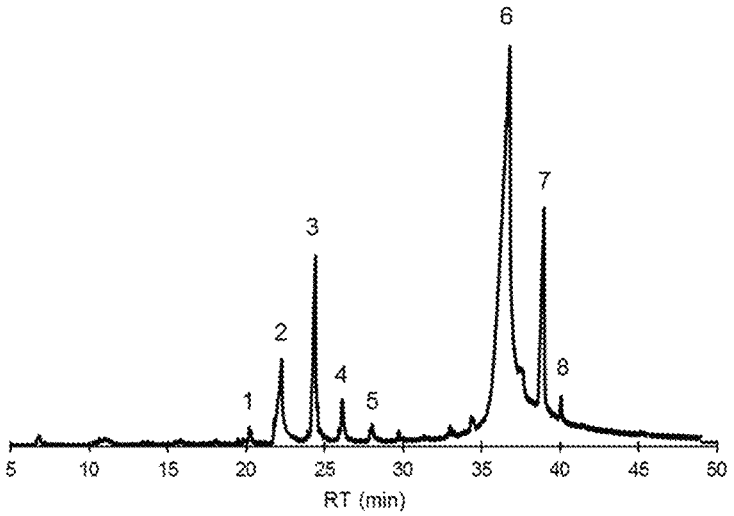
FIG. 4 shows GC-MS chromatogram of P1.
Figure 5:
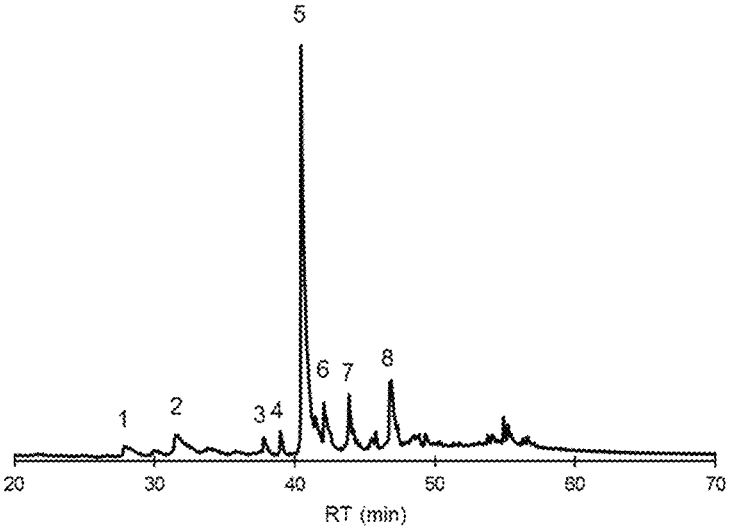
FIG. 5 shows GC-MS chromatogram of P2.
Figure 6:
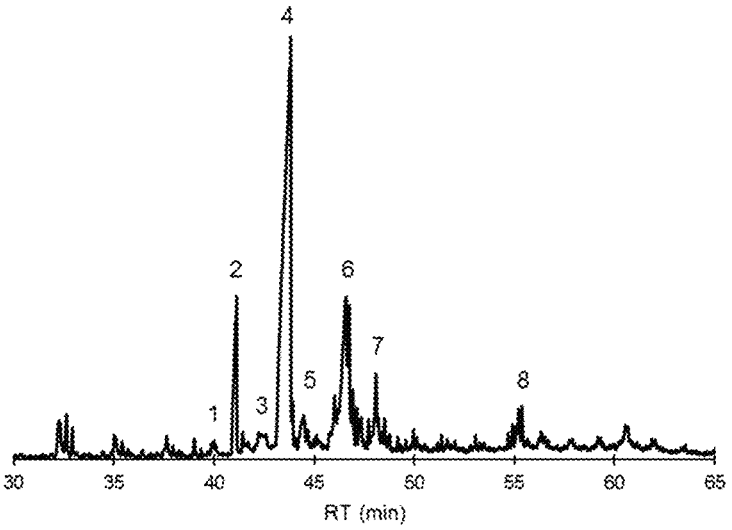
FIG. 6 shows GC-MS chromatogram of P3.
Figure 7:
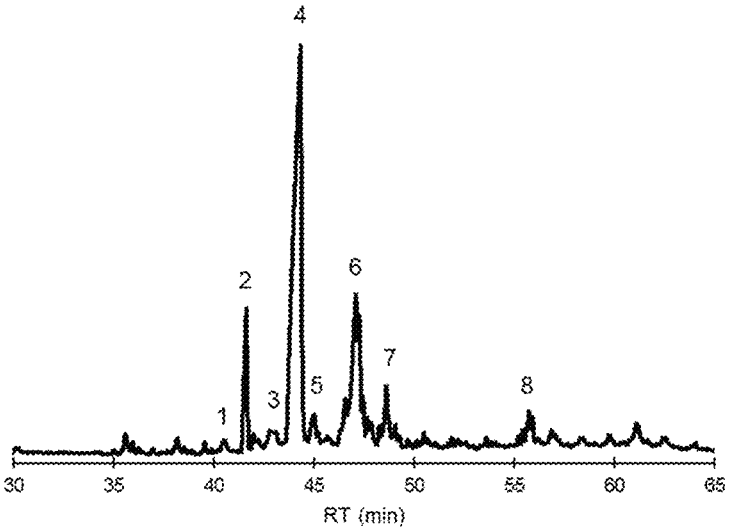
FIG. 7 shows GC-MS chromatogram of P4.
Figure 8:
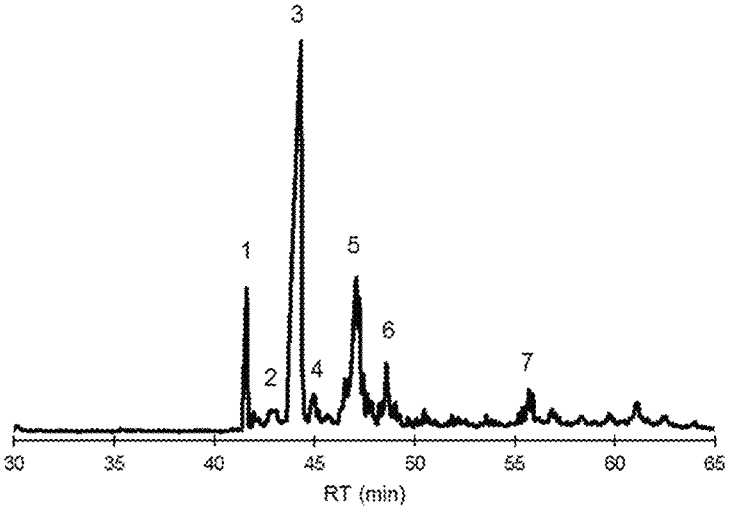
FIG. 8 shows GC-MS chromatogram of P5.
Figure 9:
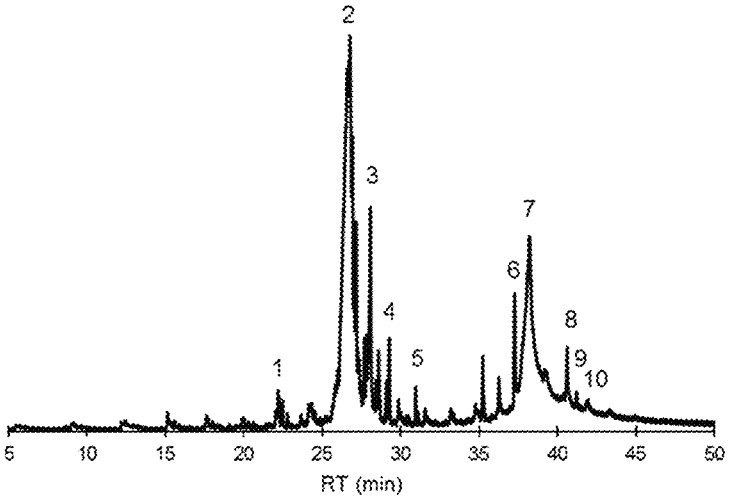
FIG. 9 shows GC-MS chromatogram of P6.
Figure 10:
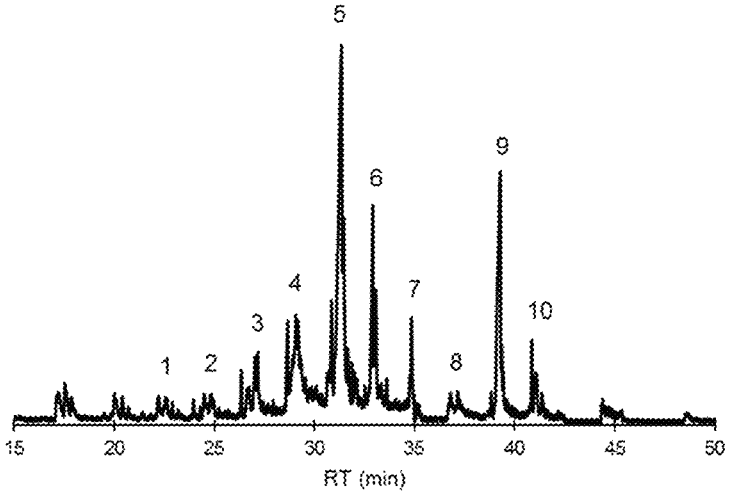
FIG. 10 shows GC-MS chromatogram of P7.
Figure 11:
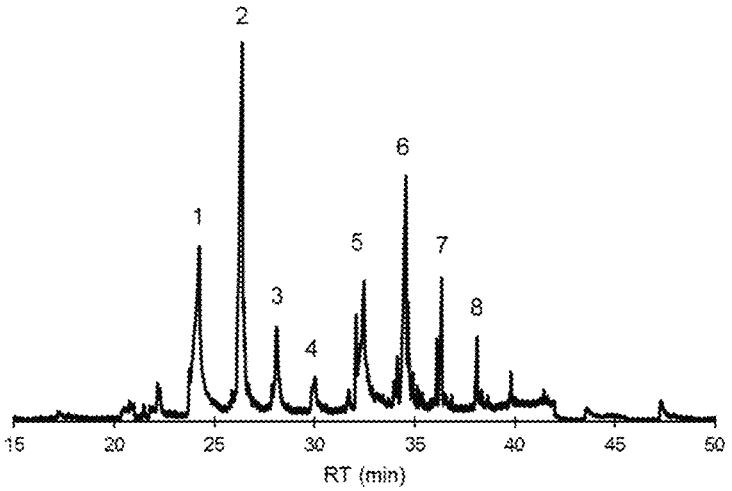
FIG. 11 shows GC-MS chromatogram of P8.
Figure 12:
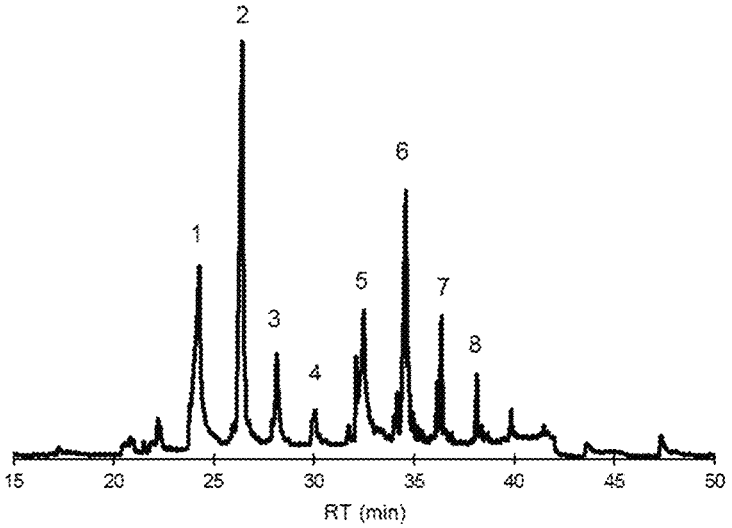
FIG. 12 shows GC-MS chromatogram of P9.
Figure 13:
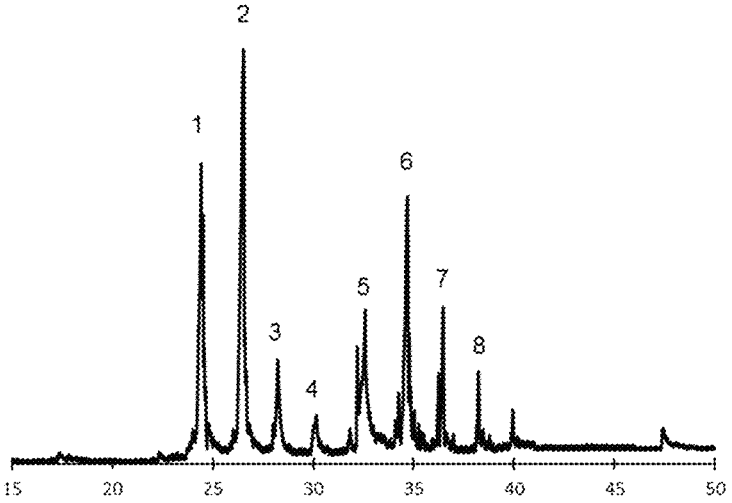
FIG. 13 shows GC-MS chromatogram of P10.

In addition to ketonization, decarboxylation of fatty acids was another source of carbon loss in the form of $CO_2$. Considering the relatively high reaction temperature (350° C.) in dehydration/ketonization step and multifunctionality of the magnetite catalyst, some in-situ hydrogen could have reacted with anhydrides, thus, deoxygenated the C=O bonds, producing compounds such as C15 ether in P1 and P6 (FIGS. 4, 9 and Tables 4, 9). However, this ether was not found in P11 suggesting, without being bound by any theory, that a more complex reaction network took place with the actual WCO.

Chemical characterization of the FC acylation/alkylation reaction products; P2, P7, P13, and P17; are presented in FIGS. 5, 10, 16, and 18, respectively (and Tables 5, 10, 16, and 18, respectively). The Friedel-Crafts (FC) acylation/alkylation is a useful synthetic pathway for the creation of aromatic ketones. Herein, both homogeneous and heterogeneous catalysts were applied to catalyze FC acylation/alkylation of 2-MF. The Cu/ZSM5-MgO catalyst was removed by filtration while sulfuric acid was neutralized after the hydrotreatment step. The FC acylation of 2-MF takes place on position 5 according to reaction (3):

(3)

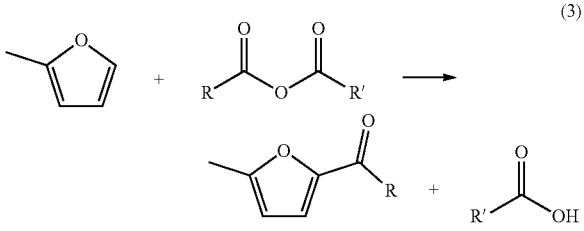

However, in the case of anisole, the alkylation reaction could take place via both reactions (4) and (5) using anhydrides and carboxylic acids as reactants, respectively[45, 46]:

(4)

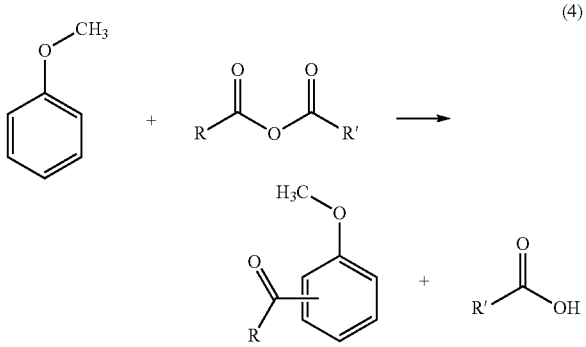

(5)

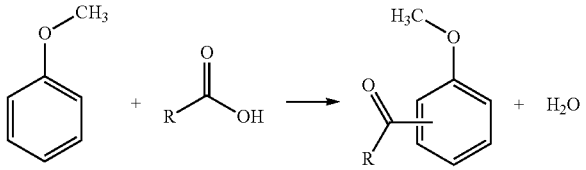

Both reactions may result in aromatic ketonic products with similar chemical structure. Hence, more detailed reaction studies would be needed to quantify the extent of each reaction. Chemical characterization of P2 (FIG. 5 and Table 5) showed the presence of CPN dimer and trimer, while the major product was a condensation product of CPN and oleic acid (peak 5 in FIG. 5). However, from the structural point of view, this compound was likely formed through enol-keto tautomerization, but the exact reaction mechanism is unknown at this time. At the same time, without being bound by any theory, the formation of cyclopentaneundecanoic acid (peak 4 in P2) may not be likely due to the reaction of CPN with acids, because the C5-ring is not attached to the carboxylic group of the acid. Instead, this compound might have formed as a result of in-situ dehydrogenation of some aliphatic chain in the dehydration/ketonization step, without being bound by any theory. FC acylation alkylation products of anisole and 2-MF with anhydrides were identified in P7, P13, and P17. In addition to FC acylation products, the C23-ester in P17 (peak 11 in FIG. 20 and Table 20 was expected to be formed via esterification of oleic acid and CPL according to reaction (6), and it is contemplated that the product of reaction (6) is a coupled product within the meaning of the present disclosure:

(6)

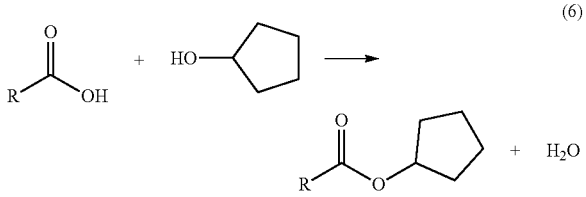

Phenolic alkylation of fatty acid methyl esters on C=C bond has been studied in a two-step process, including a first HDO step to eliminate the hydroxyl group of phenol and a second alkylation of benzene or toluene. However, the presence of aromatic-alkylated (such as peak 7 in FIG. 16 and Table 16) in this work is ascribed to FC alkylation reaction with anisole, that has been reported to occur over both homogeneous and heterogeneous acid catalysts. In addition, the C14 and C16 aromatic alkylated fatty acids (peaks 5 and 9 in FIG. 16 and Table 16) could have formed from the reaction of P12 anhydrides with anisole without being bound by any theory.

Figure 20:
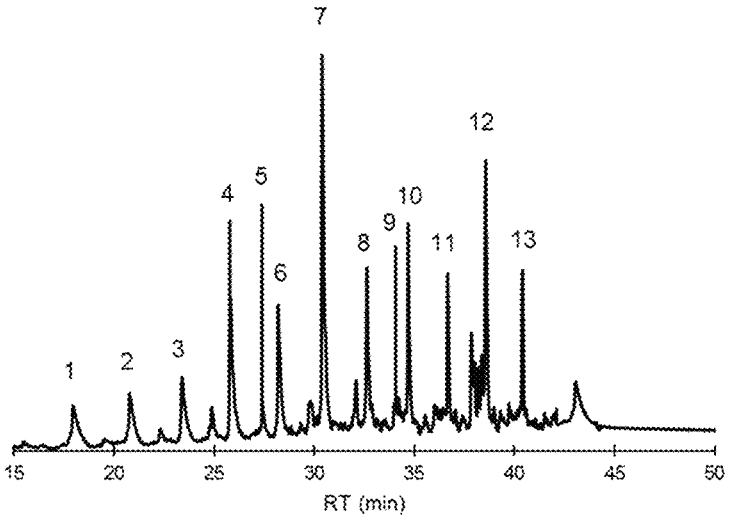
FIG. 20 shows GC-MS chromatogram of P17.
Figure 21:
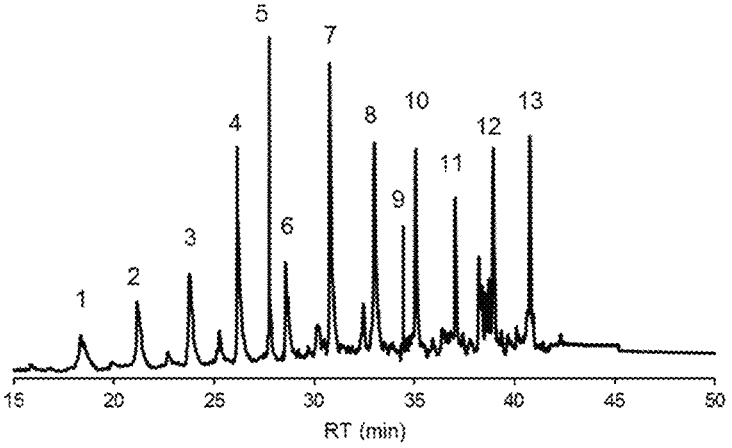
FIG. 21 shows GC-MS chromatogram of P18.
Figure 22:
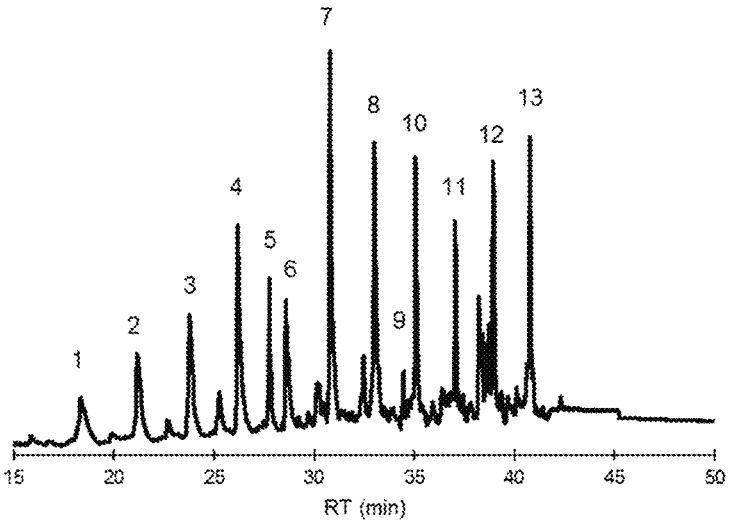
FIG. 22 shows GC-MS chromatogram of P19.
Figure 23:
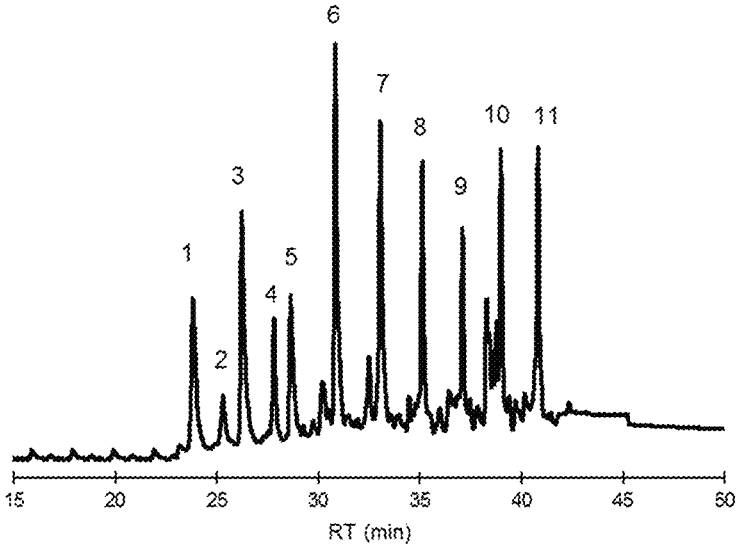
FIG. 23 shows GC-MS chromatogram of P20.

In P17, some unreacted oleic acid and anhydride were identified (peaks 5 and 8, respectively, in FIG. 20 and Table 20). However, the octanoic acid (peak 1 in FIG. 20) could have resulted as a side product of FC acylation of octanoic anhydride (peak 11 in FIG. 15 and Table 15) with cyclic oxygenates, without being bound by any theory. While the formation of octanoic anhydride could indicate some sort of reductive cleavage of oleic acid, this requires further investigation. Moreover, without being bound by any theory, linear olefins and paraffins (i.e. peaks 2, 3, and 4 in FIG. 20) could be a result of electron impact ionization and fragmentation during GC-MS analysis, and are not formed through FC acylation reaction. Overall, the reaction network could suggest that FC acylation, esterification, and aromatic alkylation of C═C were dominant pathways during the alkylation step, while the formation of some linear olefins is not clearly understood at this time.

Chemical analysis of hydrotreatment products; P3, P8, P14, and P18; are provided in FIGS. 6, 11, 17, and 21, respectively (and Tables 6, 11, 17, and 21, respectively). Hydrotreatment of P2 appeared to be effective in saturation of C═C bonds, and decarboxylation of cyclopentaneundecanoic acid. Without being bound by any theory, the C15 alkane could have formed either via ring opening of CPN trimer, or due to fragmentation of other molecules in MS detector. In addition, it was found that C═O bonds were deoxygenated in SA-derived and WCO-derived biolubricants. Furthermore, the aromatic ring was mostly hydrogenated while some unreacted aromatics were still present in the final mixture in P8. The formation of branched C39 hydrocarbon (peak 8 in FIG. 11) was ascribed to ring opening of 2-MF trimer condensation products. Some dimerization product with two C6 rings was identified in P14 that could possibly bond to C═C in the presence of acidic silica-alumina catalyst support. Without being bound by any theory, this mechanism could be assumed to be similar to producing aromatic dimers primarily, and getting hydrogenated afterwards, thus, giving the C28 compound in P14 (peak 10 in FIG. 17 and Table 17). After hydrotreatment, the biolubricants were titrated with KOH solution to neutralize sulfuric acid and small-molecular weight carboxylic acids. Except minor changes in peak intensities, the neutralization step did not show a significant influence on chemical analysis of biolubricants; P4, P9, P15, and P19; as reflected in FIGS. 7, 12, 18, and 22, respectively (and Tables 7, 12, 18, and 22, respectively). Since evaporative loss is an important characteristic of lubricants, the produced biolubricants were distilled in the final step to obtain the final biolubricant mixtures; P5, P10, P16, and P20. Overall, the distillation process appeared to remove or reduce the concentration of most chemicals that showed before 25 or 40 minutes retention time in GC-MS (depending on the heating program) (FIGS. 8, 13, 19, and 23). The remaining fractions after distillation were then evaluated for other bulk properties including pour point, viscosity, Noack volatility, thermal stability, and viscosity index.

Solid acid catalysts offer a reusable and safer alternative, and they have been successfully employed in aromatic alkylation of alkenes. The two acid types in solid acid catalysts work together during aromatic alkylation. Brønsted acid sites catalyze the formation of carbocations from alkenes and Lewis acid sites improve the interaction between carbocations and aromatics. GC-MS semi-quantification of the final BLs (P5, P10, P16, and P20) is provided in Table 24. Unsaturated FFAs and FAMEs can react with aromatic hydrocarbons via alkylation reaction because of the presence of C═C bond in the fatty chain. It has been shown that hydrodeoxygenation-alkylation using solid acid catalysts is a promising pathway to synthesize phenyl-branched FAME that can serve as a potential lubricant improver. In Aldol condensation, an enol or an enolate ion reacts with a carbonyl compound to form a β-hydroxy aldehyde or β-hydroxy ketone, followed by dehydration to produce a conjugated enone. In its usual form, aldol condensation involves the nucleophilic addition of a ketone enolate to an aldehyde to form a β-hydroxy ketone, or "aldol" (aldehyde+alcohol), a structural unit found in many naturally occurring molecules. Without being bound by any theory, the structure of C28 in P5 could suggest that oleic acid underwent chain prolongation during ketonization (P1) and then the C═O bond was deoxygenated. However, a C28 ketone was not detected in P1 which could be due to GC-MS limitations. In P10 BL, more diverse molecules were detected with cyclic or aromatic structures attached to long a long chain. Oelic acid and stearic acid reactions demonstrated that CPN, ASL, and 2-MF were suitable chemicals to react with long chain anhydrides derived from fatty acids and WCO-derived molecules. Chemical analysis of P16 BL suggested the presence of 49.5% (area percent) desired molecules that were consisted of molecules with cyclic structure attached to linear chains. The P20 BL also showed the presence of molecules with cyclic structures incorporated into linear structures with total area percent of 48.4%.

These pathways resulted in synthesis of novel bio-lubricants molecules that include cyclic compounds attached to long chain compounds of vegetable oil. These structures share several properties (simultaneously) to provide optimum lubricant characteristics: 1) long and linear hydrocarbon chains would provide good lubricity (by reducing the boundary friction coefficient) and viscosity index (VI) (viscosity temperature stability), 2) low-to-zero unsaturation could give excellent stability to the mixture, 3) minimal branching may result in very low wearing rate, 4) presence of one or two naphthenic rings (cyclic structures) can increase oxidation resistance, decrease viscosity variations with temperature (resulting greater VI), and may significantly lower the pour point (PP), and 5) polarity of some of these molecules may provide a great boundary layer with a metal surface because of the interaction of the polar groups with the metal surface (the non-polar ends form a molecular layer or barrier that separates the subbing surfaces and thus prevents direct contact). Therefore, without being bound by any theory, this process could successfully address several issues of the current bio-lubricants at the same time, without negatively influencing their suitable properties.

TABLE 3

Fatty acid composition of waste cooking oil.

| Type of fatty acid | Carbon chain | Composition (wt. %) |
|---|---|---|
| Myristic | C14:0 | 0.9 |
| Palmitic | C16:0 | 18.6 |
| Stearic | C18:0 | 1.7 |
| Oleic | C18:1 | 63.2 |
| Linoleic | C18:2 | 2.5 |
| Arachidic | C20:0 | 7.2 |
| Eicosenoic | C20:1 | 3.1 |
| Others | | 2.8 |

TABLE 4
chemical structures of P1 identified using GC-MS.
| Peak number | Identified chemical structure |
|---|---|
| 1 | 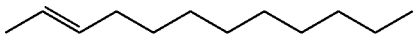 |
| 2 | 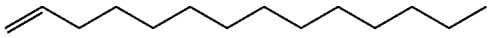 |
| 3 | 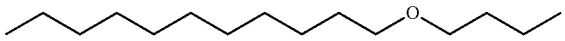 |
| 4 | 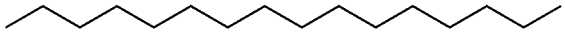 |
| 5 | 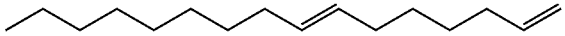 |
| 6 | 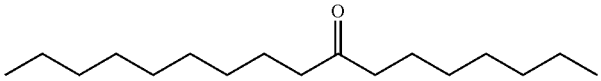 |
| 7 | 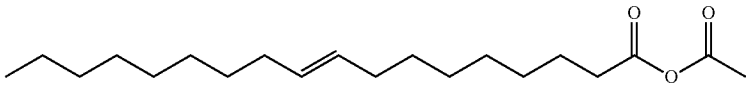 |
| 8 | 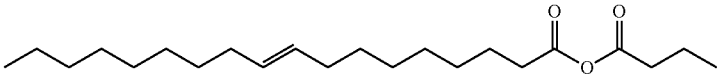 |
TABLE 5
chemical structures of P2 identified using GC-MS.
| Peak number | Identified chemical structure |
|---|---|
| 1 | 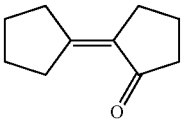 |
| 2 | 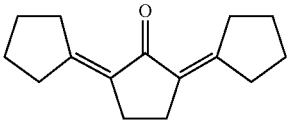 |
| 3 | 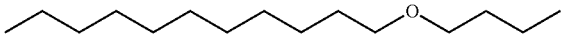 |
| 4 | 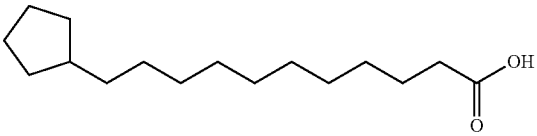 |
| 5 | 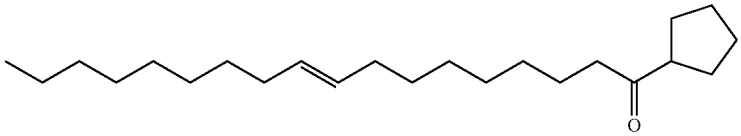 |
| 6 | 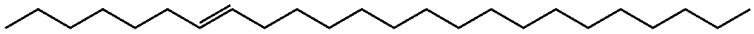 |

TABLE 5-continued chemical structures of P2 identified using GC-MS.

| Peak number | Identified chemical structure |
|---|---|
| 7 | |
| 8 | |

TABLE 6 chemical structures of P3 identified using GC-MS.

| Peak number | Identified chemical structure |
|---|---|
| 1 | |
| 2 | |
| 3 | |
| 4 | O |
| 5 | O |
| 6 | |
| 7 | |
| 8 | |

TABLE 7 chemical structures of P4 identified using GC-MS.

| Peak number | Identified chemical structure |
|---|---|
| 1 | |
| 2 | |
| 3 | |

TABLE 7-continued
chemical structures of P4 identified using GC-MS.
| Peak number | Identified chemical structure |
|---|---|
| 4 | 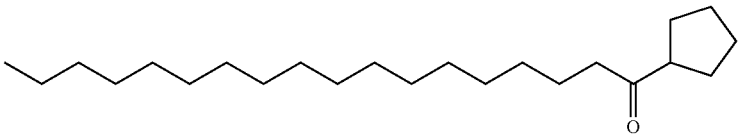 |
| 5 | 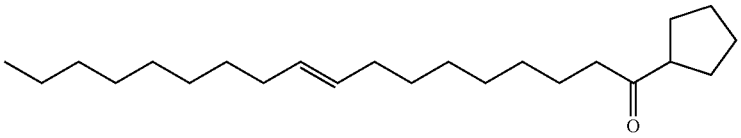 |
| 6 | 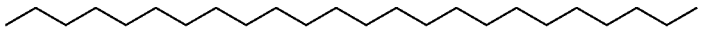 |
| 7 | 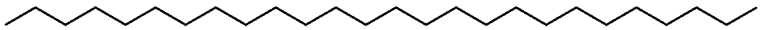 |
| 8 | 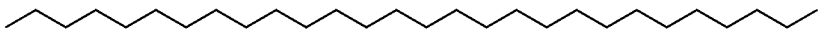 |
TABLE 8
chemical structures of P5 identified using GC-MS.
| Peak number | Identified chemical structure |
|---|---|
| 1 | 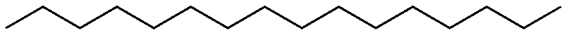 |
| 2 | 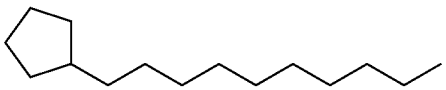 |
| 3 | 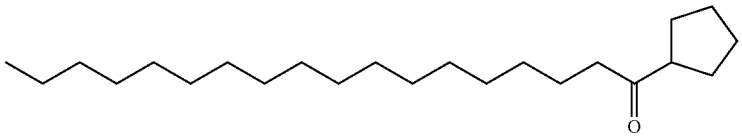 |
| 4 | 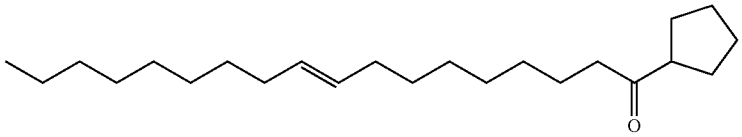 |
| 5 | 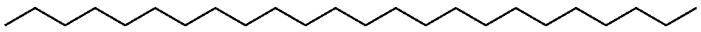 |
| 6 | 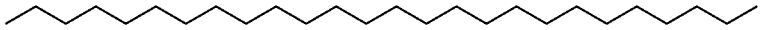 |
| 7 | 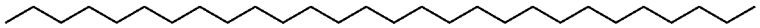 |

TABLE 9 chemical structures of P6 identified using GC-MS.

| Peak number | Identified chemical structure |
|---|---|
| 1 | |
| 2 | HO |
| 3 | O |
| 4 | |
| 5 | |
| 6 | O |
| 7 | O O O |
| 8 | O O O |
| 9 | O O O |
| 10 | O O O |

TABLE 10 chemical structures of P7 identified using GC-MS

| Peak number | Identified chemical structure |
|---|---|
| 1 | O OH |
| 2 | O OH |
| 3 | $OCH_3$ O |

TABLE 10-continued
| chemical structures of P7 identified using GC-MS | |
|---|---|
| Peak number | Identified chemical structure |
| 4 | 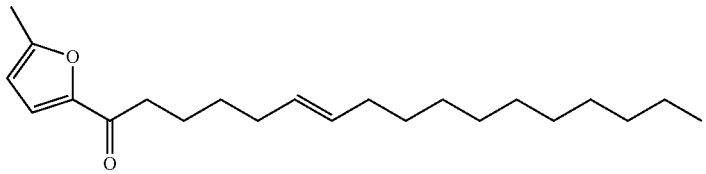 |
| 5 | 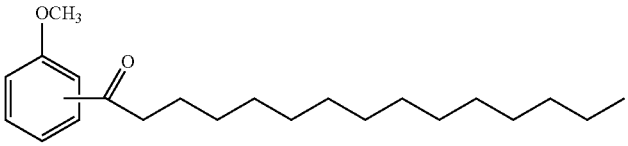 |
| 6 | 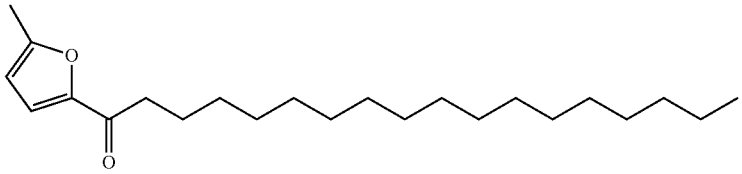 |
| 7 | 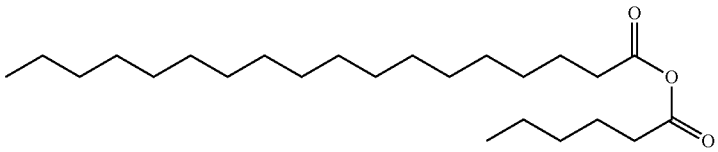 |
| 8 | 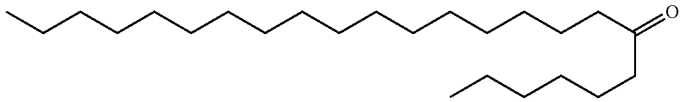 |
| 9 | 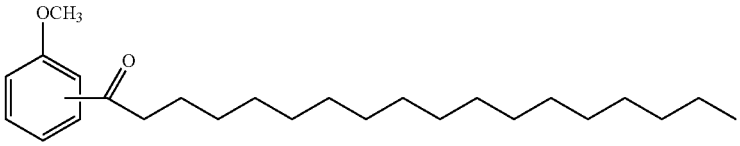 |
| 10 | 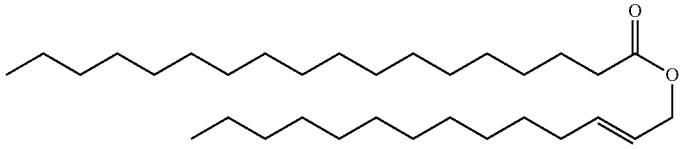 |

TABLE 11
chemical structures of P8 identified using GC-MS.
| Peak number | Identified chemical structure |
|---|---|
| 1 | 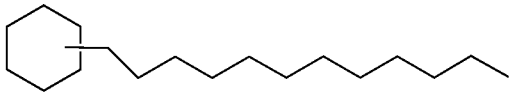 |
| 2 | 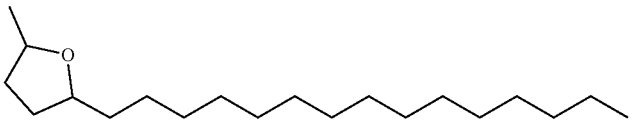 |
| 3 | 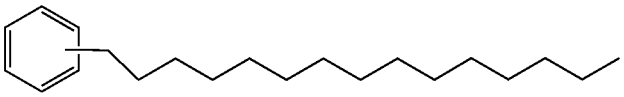 |
| 4 | 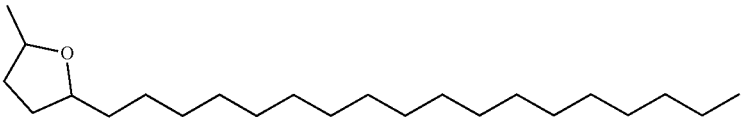 |
| 5 | 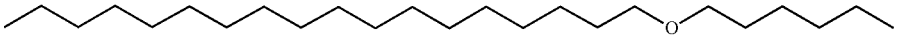 |
| 6 | 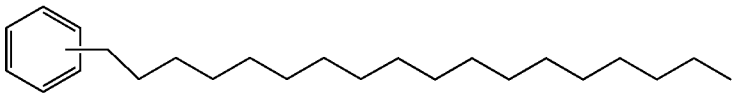 |
| 7 | 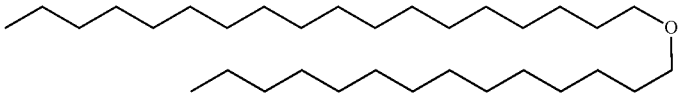 |
| 8 | 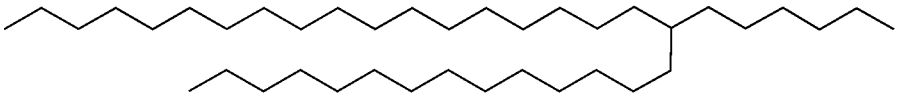 |
TABLE 12
chemical structures of P9 identified using GC-MS.
| Peak number | Identified chemical structure |
|---|---|
| 1 | 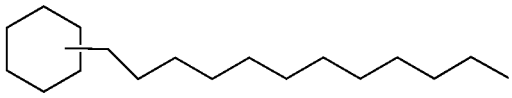 |
| 2 | 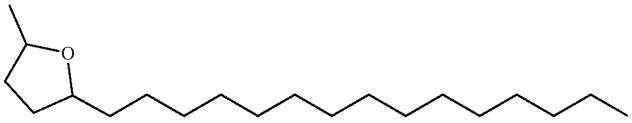 |
| 3 | 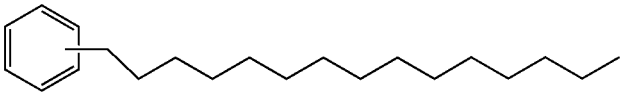 |

TABLE 12-continued
chemical structures of P9 identified using GC-MS.
| Peak number | Identified chemical structure |
|---|---|
| 4 | 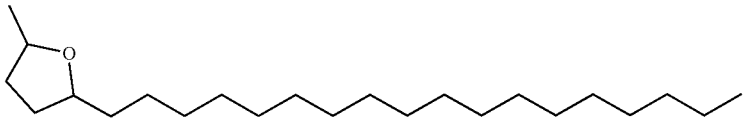 |
| 5 | 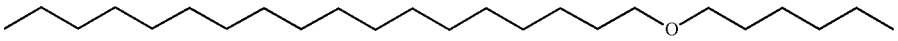 |
| 6 | 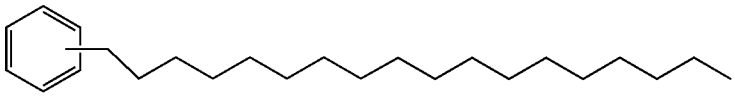 |
| 7 | 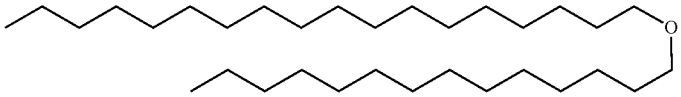 |
| 8 | 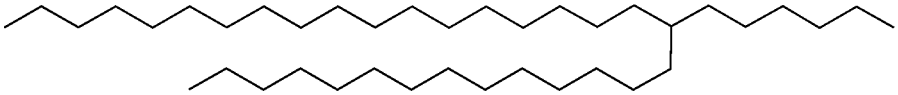 |
TABLE 13
chemical structures of P10 identified using GC-MS.
| Peak number | Identified chemical structure |
|---|---|
| 1 | 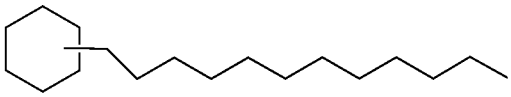 |
| 2 | 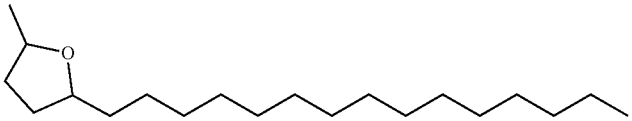 |
| 3 | 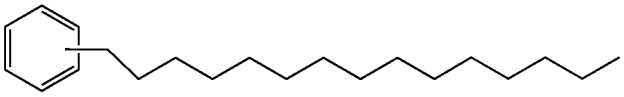 |
| 4 | 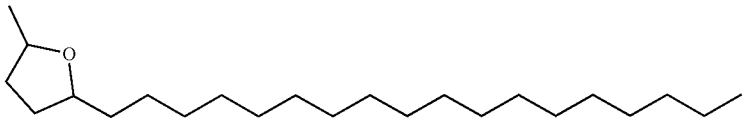 |
| 5 | 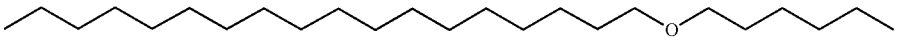 |
| 6 | 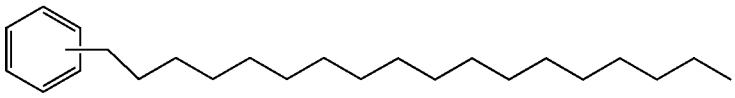 |
| 7 | 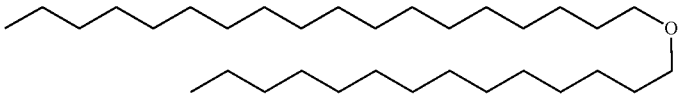 |

TABLE 13-continued chemical structures of P10 identified using GC-MS.

| Peak number | Identified chemical structure |
|---|---|
| 8 | |

TABLE 14 chemical structures of P11 identified using GC-MS.

| Peak number | Chemical structure |
|---|---|
| 1 | |
| 2 | |
| 3 | |
| 4 | |
| 5 | |
| 6 | |
| 7 | |

TABLE 15 chemical structures of P12 identified using GC-MS.

| Peak number | Identified chemical structure |
|---|---|
| 1 | |
| 2 | |
| 3 | |
| 4 | |
| 5 | |

TABLE 15-continued
chemical structures of P12 identified using GC-MS.
| Peak number | Identified chemical structure |
|---|---|
| 6 | 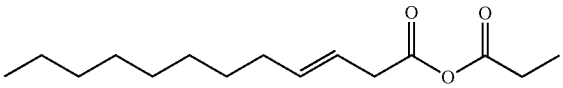 |
| 7 | 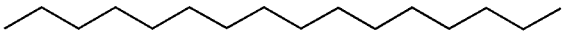 |
| 8 | 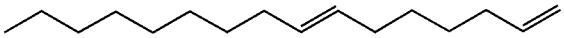 |
| 9 | 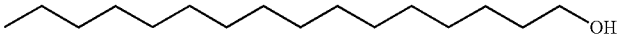 |
| 10 | 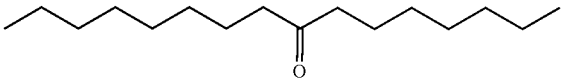 |
| 11 | 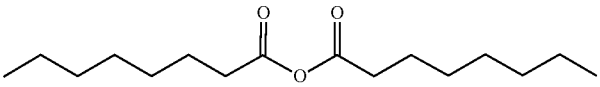 |
| 12 | 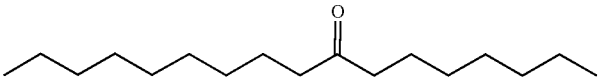 |
| 13 | 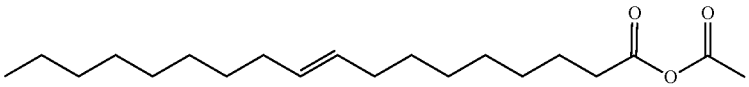 |
| 14 | 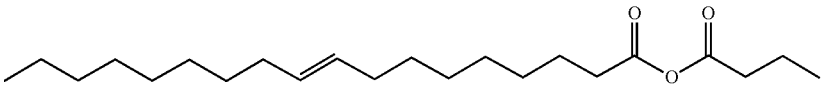 |
TABLE 16
chemical structures of P13 identified using GC-MS.
| Peak number | Identified chemical structure |
|---|---|
| 1 | 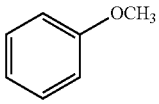 |
| 2 | 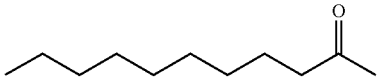 |
| 3 | 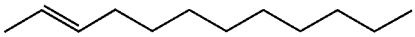 |
| 4 | 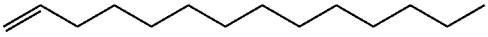 |
| 5 | 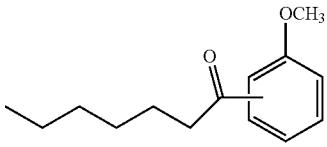 |
| 6 | 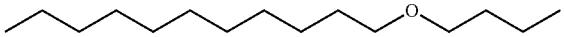 |

TABLE 16-continued
chemical structures of P13 identified using GC-MS.
| Peak number | Identified chemical structure |
|---|---|
| 7 | 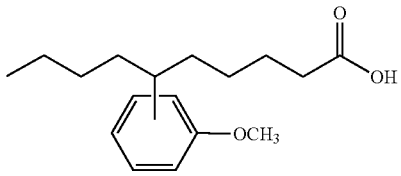 |
| 8 | 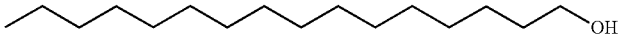 |
| 9 | 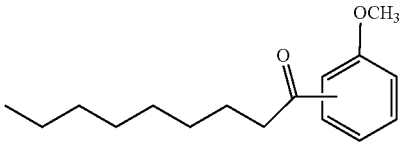 |
| 10 | 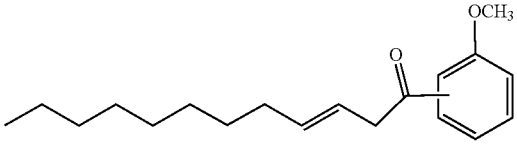 |
| 11 | 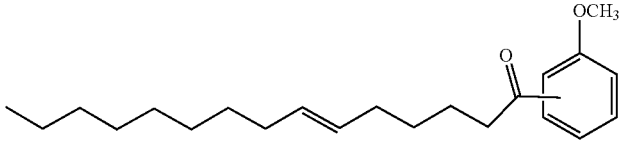 |
| 12 | 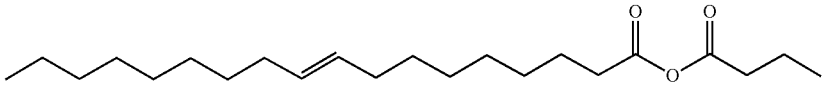 |
| 13 | 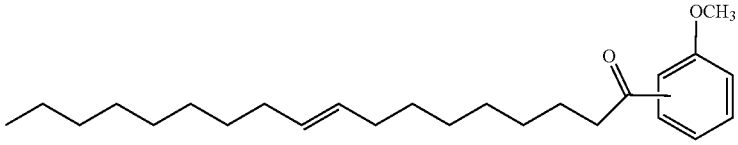 |
TABLE 17
chemical structures of P14 identified using GC-MS.
| Peak number | Identified chemical structure |
|---|---|
| 1 | 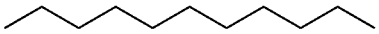 |
| 2 | 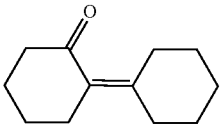 |
| 3 | 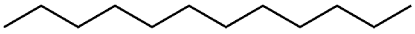 |
| 4 | 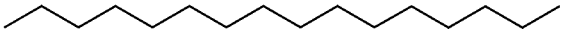 |
| 5 | 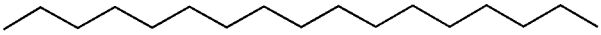 |

TABLE 17-continued
chemical structures of P14 identified using GC-MS.
| Peak number | Identified chemical structure |
|---|---|
| 6 | 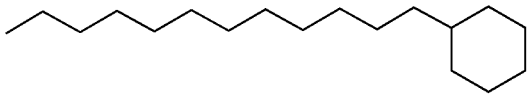 |
| 7 | 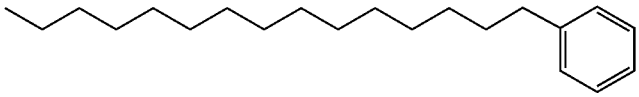 |
| 8 | 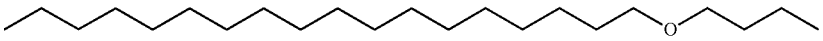 |
| 9 | 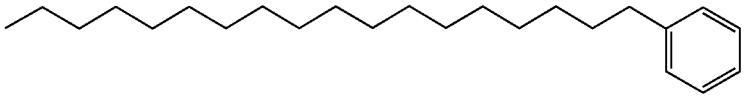 |
| 10 | 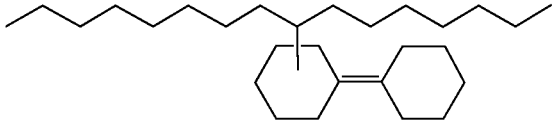 |
TABLE 18
chemical structures of P15 identified using GC-MS.
| Peak number | Identified chemical structure |
|---|---|
| 1 | 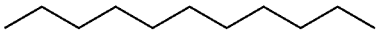 |
| 2 | 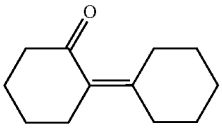 |
| 3 | 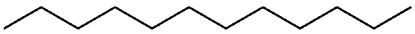 |
| 4 | 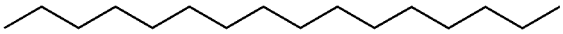 |
| 5 | 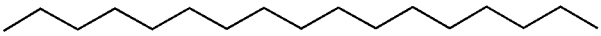 |
| 6 | 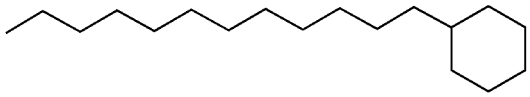 |
| 7 | 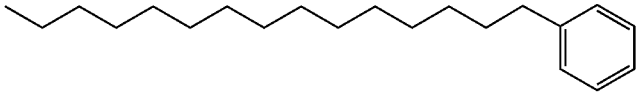 |
| 8 | 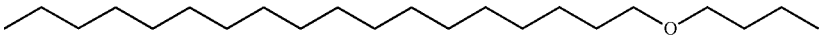 |
| 9 | 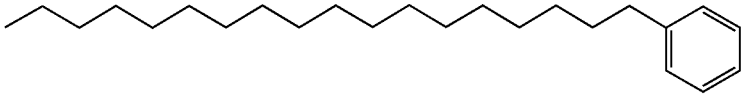 |

TABLE 18-continued chemical structures of P15 identified using GC-MS.

| Peak number | Identified chemical structure |
|---|---|
| 10 | |

TABLE 19 chemical structures of P16 identified using GC-MS.

| Peak number | Identified chemical structure |
|---|---|
| 1 | |
| 2 | |
| 3 | |
| 4 | |
| 5 | O |
| 6 | |
| 7 | |

TABLE 20 chemical structures of P17 identified using GC-MS.

| Peak number | Identified chemical structure |
|---|---|
| 1 | O OH |
| 2 | |
| 3 | |
| 4 | |
| 5 | O OH |

TABLE 20-continued
chemical structures of P17 identified using GC-MS.
| Peak number | Identified chemical structure |
|---|---|
| 6 | 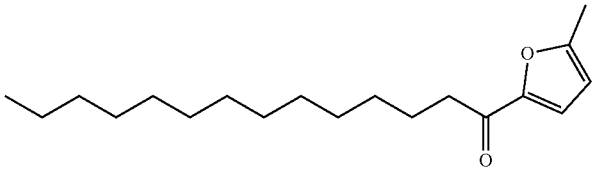 |
| 7 | 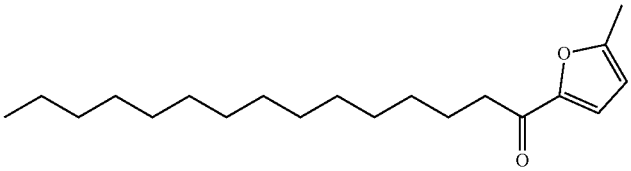 |
| 8 | 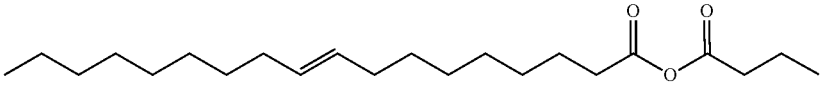 |
| 9 | 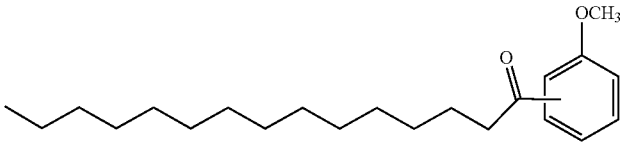 |
| 10 | 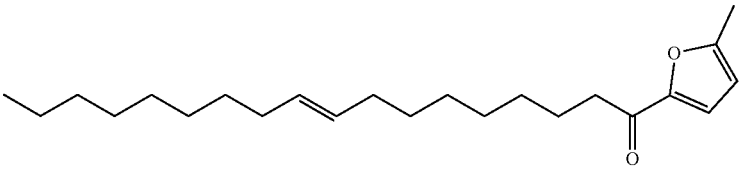 |
| 11 | 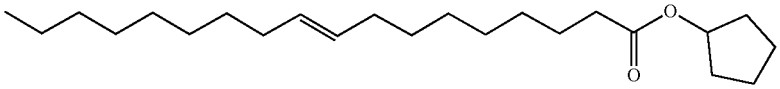 |
| 12 | 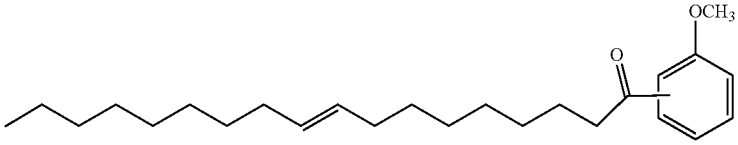 |
| 13 | 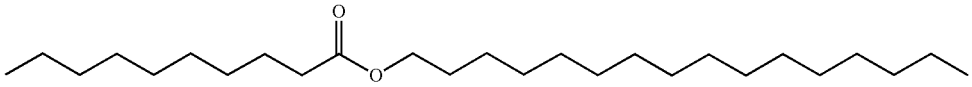 |
TABLE 21
chemical structures of P18 identified using GC-MS.
| Peak number | Identified chemical structure |
|---|---|
| 1 | 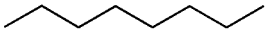 |
| 2 | 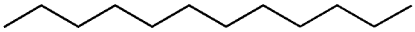 |
| 3 | 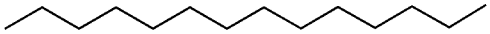 |

TABLE 21-continued chemical structures of P18 identified using GC-MS.

| Peak number | Identified chemical structure |
|---|---|
| 4 | |
| 5 | |
| 6 | |
| 7 | |
| 8 | |
| 9 | |
| 10 | |
| 11 | |
| 12 | |
| 13 | |

TABLE 22 chemical structures of P19 identified using GC-MS.

| Peak number | Identified chemical structure |
|---|---|
| 1 | |
| 2 | |
| 3 | |
| 4 | |
| 5 | |

TABLE 22-continued
chemical structures of P19 identified using GC-MS.
| Peak number | Identified chemical structure |
|---|---|
| 6 | 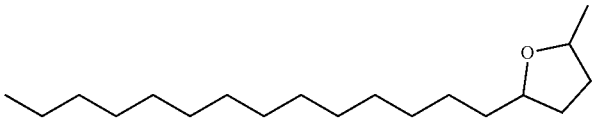 |
| 7 | 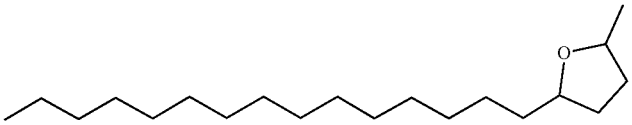 |
| 8 | 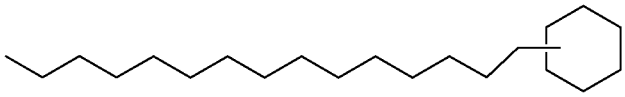 |
| 9 | 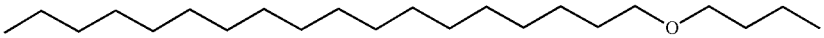 |
| 10 | 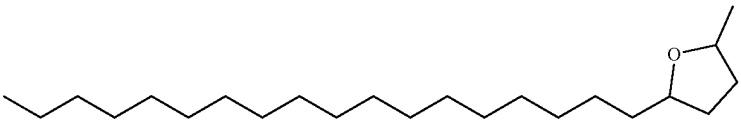 |
| 11 | 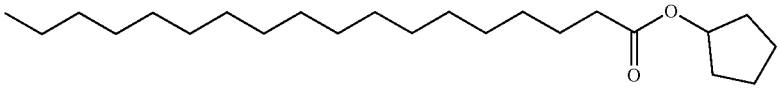 |
| 12 | 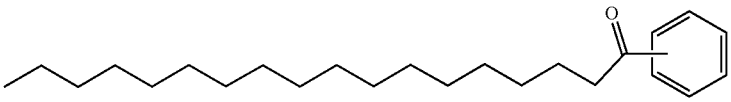 |
| 13 | 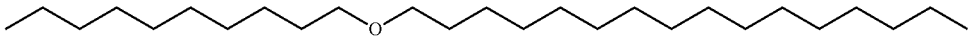 |
TABLE 23
chemical structures of P20 identified using GC-MS.
| Peak number | Identified chemical structure |
|---|---|
| 1 | 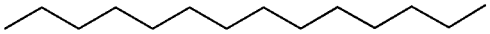 |
| 2 | 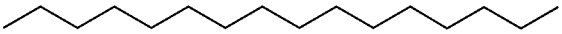 |
| 3 | 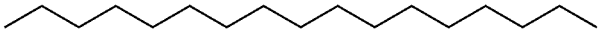 |
| 4 | 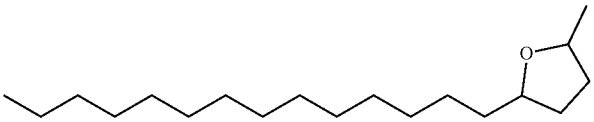 |
| 5 | 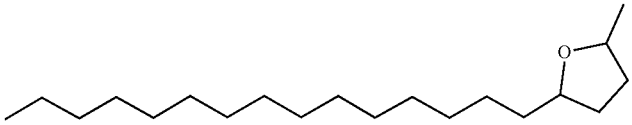 |

TABLE 23-continued chemical structures of P20 identified using GC-MS.

| Peak number | Identified chemical structure |
|---|---|
| 6 | |
| 7 | |
| 8 | |
| 9 | |
| 10 | |
| 11 | |

TABLE 24

GC-MS semi-quantification of featured BL molecules.

| BL code | Chemical structure | Chemical formula | MW | Area % |
|---|---|---|---|---|
| P5 | | $C_{16}H_{34}$ | 226.4 | 11.2 |
| | | $C_{15}H_{30}$ | 210.4 | 2.5 |
| | | $C_{23}H_{44}O$ | 336.6 | 34.3 |
| | | $C_{23}H_{42}O$ | 334.6 | 3.8 |
| | | $C_{24}H_{50}$ | 338.6 | 14.5 |

TABLE 24-continued

GC-MS semi-quantification of featured BL molecules.

| BL code | Chemical structure | Chemical formula | MW | Area % |
|---|---|---|---|---|
| | | $C_{26}H_{54}$ | 366.7 | 7.4 |
| | | $C_{28}H_{28}$ | 394.7 | 5.5 |
| SUM area % quantified | | | | 79.2 |
| P10 | | $C_{18}H_{37}$ | 253.5 | 19.6 |
| | | $C_{20}H_{30}O$ | 286.4 | 22.5 |
| | | $C_{21}H_{36}$ | 288.5 | 2.1 |
| | | $C_{23}H_{46}O$ | 338.6 | 0.5 |
| | | $C_{24}H_{50}O$ | 354.6 | 10.3 |
| | | $C_{24}H_{42}$ | 330.6 | 17.4 |
| | | $C_{32}H_{66}O$ | 466.8 | 9.3 |
| | | $C_{39}H_{80}$ | 549.0 | 5.6 |
| SUM area % quantified | | | | 87.3 |
| P16 | | $C_{16}H_{34}$ | 226.4 | 5.6 |
| | | $C_{17}H_{36}$ | 240.4 | 3.4 |
| | | $C_{18}H_{36}$ | 252.5 | 9.3 |
| | | $C_{21}H_{36}$ | 288.5 | 13.7 |
| | | $C_{22}H_{46}O$ | 326.6 | 11.6 |

TABLE 24-continued

GC-MS semi-quantification of featured BL molecules.

| BL code | Chemical structure | Chemical formula | MW | Area % |
|---|---|---|---|---|
| | | $C_{24}H_{42}$ | 330.6 | 15.4 |
| | | $C_{28}H_{52}$ | 388.7 | 11.1 |
| SUM area % quantified | | | | 70.1 |
| P20 | | $C_{24}H_{30}$ | 318.5 | 5.7 |
| | | $C_{16}H_{34}$ | 226.4 | 1.1 |
| | | $C_{17}H_{36}$ | 240.4 | 7.8 |
| | | $C_{19}H_{38}O$ | 282.5 | 3.5 |
| | | $C_{20}H_{40}O$ | 296.5 | 5.2 |
| | | $C_{21}H_{42}$ | 294.5 | 14 |
| | | $C_{22}H_{46}O$ | 326.6 | 11.2 |
| | | $C_{23}H_{46}O$ | 338.6 | 9.3 |
| | | $C_{23}H_{44}O_2$ | 352.6 | 6.9 |
| | | $C_{24}H_{40}O$ | 344.5 | 9.5 |
| | | $C_{26}H_{54}O$ | 382.7 | 9.6 |
| SUM area % quantified | | | | 83.8 |

EXAMPLE 4

Influence of Integrated Processes on Bulk Properties

In the instant example, the experimental matrix used in this work was shown in Table 1. Two sets of experiments were performed using oleic acid (exp. 1-5 in Table 1) and stearic acid (exp. 6-10 in Table 1) as WCO model compounds. In addition, two series of experiments were carried out using real WCO feedstock presented by exp. 11-16 and exp. 18-21 in Table 1. Several parameters, namely pour point (PP), $KV_{40}$, VI, Noack volatility, and TAN of the liquid products were measured after each step to track down the influence of each process on such properties as presented in FIGS. 24, 25, 26, 27, and 28, respectively. Hydrolysis was carried out only on WCO feedstock to produce free fatty acids that are more reactive than the parent triglyceride molecules. The hydrolysis step caused an increase in PP of the WCO from 8 to 13° C. (FIG. 24B). In general, lubricants with low pour points are desirable since these lubricants provide good lubrication at extremely low temperatures as well as during cold starts. High levels of unsaturation and oxygen content can negatively affect the low temperature properties and oxidative stability of lubricants. Therefore, without being bound by any theory, it can be required to partially/completely hydrogenate the lubricant base oil compounds. FC acylation/alkylation, HDO, neutralization, and distillation showed a decreasing trend on the PP of BL derived from both WCO and fatty acids. The influence of FC acylation/alkylation reaction on PP reduction was more pronounced in stearic acid-BL compared to other experiments. In addition, the BLs derived from oleic acid and stearic acid showed relatively higher PP in each step compared to WCO.

A very high viscosity will increase the oil temperature and drag whereas a very low viscosity will increase the metal-to-metal contact friction between the moving parts. The carbon chain length is one of the factors which affects the viscosity of the lubricant. Low-viscosity lubricants are less resistant to flow, hence their fuel economy benefits. Without being bound by any theory, hydrolysis, had a positive effect on reducing $KV_{40}$ of the WCO (FIG. 25B), suggesting that fatty acids in general could have higher PP and lower viscosity compared to the original WCO. The increase in $KV_{40}$ of the liquid products after dehydration/ketonization treatment confirmed the production of larger molecules, as discussed under physicochemical characterization of bio-lubricants. In a kinetics investigation of stearic acid ketonization, 18-pentatriacontanone was successfully produced in a non-catalytic reaction at 350° C. The long chain ketone can be further deoxygenated to bio-wax or heavy fuel. Also, experimental evidence showed that the cross ketonization of stearic acid with lauric acid produced products of lauric acid homo-ketonization and a cross-ketonic decarboxylation of lauric and stearic acid, besides 18-pentatriacontanone. Without being bound by any theory, these studies could demonstrate the viable conversion of renewable bio-derived compounds into larger carbon chains and value-added products that could be useful for bio-fuel applications, but they were not suitable lubricants. Because of the solid nature of stearic acid and its dehydration/ketonization products at room temperature, $KV_{40}$ was not determined due to instrumental limitations. Thus, such information are not provided in FIG. 25A. Overall, hydrolysis of WCO decreased its viscosity, and then the viscosity was increased after dehydration/ketonization treatment. All post-dehydration/ketonization steps helped to lower the $KV_{40}$ consistently as shown in FIG. 25, with relatively higher $KV_{40}$ of WCO-BL compared than fatty acid-BLs.

The viscosity index (VI) is an arbitrary, unit-less measure of a fluid's change in viscosity relative to temperature change. A high VI is an essential characteristic of good lubricant since it is an indication that the lubricant can be used over a wide range of temperatures by maintaining the thickness of the oil film. Lower viscosity in conjunction with maximizing the VI ensures that the oil viscosity varies as little as possible with temperature. This means that the lubricant should have a low viscosity upon cold-start, so that the oil reaches engine parts rapidly, and should not drop in viscosity at higher temperatures, thereby maintaining wear protection once the engine has warmed up. VI of oleic acid decreased from 200 to 157 after dehydration/ketonization and from 157 to 140 after FC acylation/alkylation with CPN. Even though different oxygenates were reacted with oleic acid and stearic acid (CPN and ASL respectively), the VI increased consistently after the FC acylation/alkylation step (FIG. 26A). Maximum VIs of 177 and 175.5 were achieved from oleic acid-BL and stearic acid-BL respectively, after the distillation step. In the case of WCO-BLs, hydrolysis caused a decrease in VI first, and then the VI increased continuously throughout the catalytic processes. This was one of the major advantages of the proposed method, because the high VI of WCO was restored at the end of BL production process. Other chemical modifications, such as epoxidation and esterification normally cause a dramatic decrease in the VI of vegetable oil-derived bio-lubricants.

The Noack volatility test determines the evaporation loss of lubricants in high-temperature service. For example, the minimum acceptable volatility specifications for SAE 5W-30, low-30, and 15W-30 engine oils allow maximum evaporative weight losses of 25, 20 and 15% respectively by the Noack method. As expected, hydrolysis of WCO increased its Noak volatility from 14.8% to 16.4% (FIG. 27B) because of production of lighter compounds (i.e. free fatty acids and linear oxygenates) than the original WCO. Noak volatility trends during other treatment appeared to follow similar trends both on model fatty acids and WCO bio-lubricants. When underwent dehydration/ketonization, fatty acids and WCO decreased in Noak volatility due to the production of larger molecules. After the FC acylation/alkylation step, Noak volatility increased significantly from approximately 7% to about 32% in fatty acid experiments (FIG. 27A), and from 10.7% to approximately 25% in WCO experiments (FIG. 27B). Thereafter, the Noak volatility decreased continuously to about 20% and 16% for fatty acids- and WCO-derived BLs, respectively. Such levels of evaporative losses were within the acceptable ~25% range of most commercial engine oils.

Hydrolytic stability (normally determined by ASTM D2619-09) implies the tendency of lubricant molecules to hydrolyze. Hydrolysis is the degradation of BL molecules in the presence of water and high temperature to cleave back into acid and alcohol. Hydrolysis is an undesirable phenomenon in the utilization of organic esters. Bio-lubricants having a lower total acid number (TAN) show higher hydrolytic stability. Therefore, the TAN of BLs was monitored between steps as presented in FIG. 28. As expected, the hydrolysis reaction increased the TAN of WCO from 46 to 107 mgKOH/g, but it did not reach to about 120 mgKOH/g of oleic acid suggesting that the hydrolysis reaction might be incomplete or disturbed by other side products. The dehydration/ketonization step had the most significant influence on TAN reduction versus other steps.

TAN reductions from 120 to 35 mgKOH/g and from 107 to 18 mgKOH/g were observed for model fatty acid-BL and WCO-BL, respectively (FIGS. 28A and 28B, respectively). Interestingly, the TAN trend in different sets of BL production experiments overlapped closely, even though different cyclic oxygenates were used in those reactions.

Figure 29:
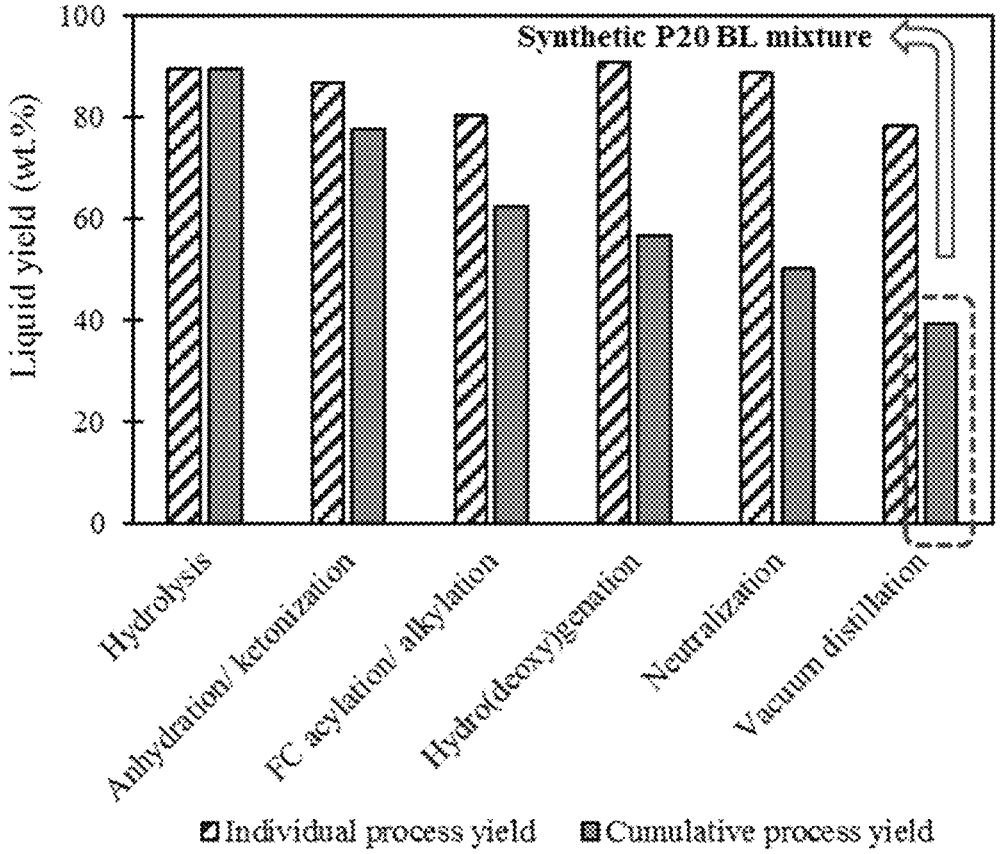
FIG. 29 shows individual and cumulative process yields during the production of P20 BL (experiments 11, 12, 18-21 in Table 1).

The economic performance of many modern production processes is substantially influenced by process yields. Their first effect is on product cost—in some cases, low-yields can cause costs to double or worse. Yet measuring only costs can substantially underestimate the importance of yield improvement. FIG. 29 shows typical process yield (both cumulative and individual yields) for the production of P20 BL (experiments 11, 12, 18-21 in Table 1). Individual process yields were determined based on the amount of output product obtained from a given amount of feed material in that specific step. Cumulative process yield were estimated by consecutive multiplication of individual yields as the integrated process moves forward. The latter would account for the cumulative loss and can be a suitable criterion for techno-economic analysis. Individual steps showed liquid yields within the range of 80-90% while a decreasing trend was observed on the cumulative process yields as expected. The overall yield of P20 BL was ~40% of the original reactants (WCO, ASL, 2-MF, and CPL). Although the ultimate yield of the proposed pathway may not seem too promising, this research being the first of its kind, has the potential for future works with the goal of process optimization and reaction mechanism identification to increase the BL production yield.

Lubricant properties of feedstocks (fatty acids and WCO) and synthetic BLs, including PP, $KV_{40}$, $KV_{100}$, VI, TGA Noack, and TAN are presented in Table 25. For comparison, such analyses were performed on three selected commercial engine oils; OW-20 (full synthetic), 10W-40 (conventional engine oil), and 15W-40 (heavy duty diesel engine oil) as well as mineral oil. It is important to note that the commercial engine oils contain 10-25 wt. % additives including pour point depressants, anti-wear agents, VI improvers, and antioxidants. Thus, in order to provide fair comparison, our BL samples are also compared with vegetable oil-based BLs and synthetic BLs produced from pure chemicals as reported in the literature (Table 25). In general, pure synthetic BLs are reported to have much lower PP compared to those derived from vegetable oil feedstocks, however, such products require more expensive reactants compared to WCO. PP results of P16 and P20 showed clear improvement compared with those adopted from the literature. Quite interestingly, all BLs produced in the present study had significantly higher VIs than pure BLs and even commercial engine oils. Except P10, other BLs showed evaporative loss less than 20% with TAN values comparable to commercial lubricants. Nevertheless, the need for product purification, fractionation, and the study of synthesized molecules in pure form is not questionable. As seen in Table 25, P5, P10, P16 and P20 have slightly lower kinematic viscosities ($KV_{40}$ and $KV_{100}$) and relatively higher VIs than engine oils, indicating that they may be able to offer fuel economy benefits over current synthetic lubricants. These results clearly suggested that our proposed method could be a superior approach for the production of novel bio-lubricants from WCO with good flow properties.

TABLE 25

Property evaluation of synthetic bio-lubricants and commercial engine oils.

| (Bio)lubricant | | PP (° C.) | $KV_{40}$ (cp) | $KV_{100}$ (cp) | VI | TGA Noack (wt. %) | TAN (mg KOH/g) |
|---|---|---|---|---|---|---|---|
| Feed Stock | WCO | 8 | 40.3 | 6.3 | 174.3 | 14.8 | 46.1 |
| | Oleic acid | 18 | 19.4 | 4.9 | 199.6 | 29.9 | 125.4 |
| | Stearic acid | 73 | NA | NA | NA | 32.0 | 123.5 |
| Present Study | P5 (FA[1]-derived) (exp. 5) | −5 | 15.6 | 3.5 | 177.3 | 19.1 | 0.8 |
| | P10 (FA-derived) (exp. 10) | −7 | 19.7 | 5.7 | 175.5 | 24.0 | 0.9 |
| | P16 (WCO-derived) (exp. 16) | −10 | 38.9 | 7.8 | 172.0 | 17.5 | 0.9 |
| | P20 (WCO-derived) (exp. 20) | −12 | 47.5 | 9.0 | 186.3 | 16.4 | 1.1 |
| Commercial lubricants | Mineral oil | −22 | 70.0 | 8.1 | 79.1 | 30.4 | <0.1 |
| | OW-20 | −18 | 44.5 | 8.7 | 179.3 | 8.3 | <0.1 |
| | 10W-40 | −16 | 101.1 | 15.1 | 156.6 | 12.4 | <0.1 |
| | 15W-40 | −21 | 112.6 | 15.0 | 138.5 | 10.4 | <0.1 |
| Vegetable oil-based BLs | Jatropha oil | 0 | 146.5 | 18.2 | 139 | — | — |
| | Jatropha oil/TMP[2] | −6 | 43.9 | 8.7 | 180 | — | — |
| | Sunflower oil/octanol-3 | −3 | 7.9 | 2.7 | 226 | — | — |
| | WCO-based esters | −6 | 15.5 | 4.2 | 104 | — | — |
| Synthetic lubricants from pure chemicals | 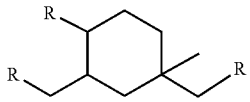 R = n-pentyl | −69 | 17.0 | 3.4 | 40 | 58.3 | — |
| | 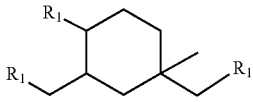 $R_1$ = n-dodecyl | −9 | 9.6 | 59.5 | 146 | 1.15 | — |

TABLE 25-continued

Property evaluation of synthetic bio-lubricants and commercial engine oils.

| (Bio)lubricant | PP (° C.) | $KV_{40}$ (cp) | $KV_{100}$ (cp) | VI | TGA Noack (wt. %) | TAN (mg KOH/g) |
|---|---|---|---|---|---|---|
| 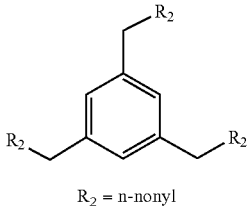 $R_2$ = n-nonyl | −24 | 18.5 | 4.4 | 150 | 3.6 | — |
| 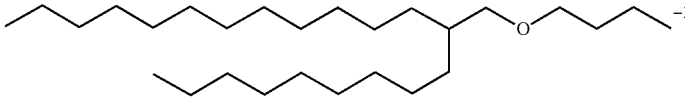 | −21 | 11.1 | 3.1 | 143 | 11.9 | — |
| 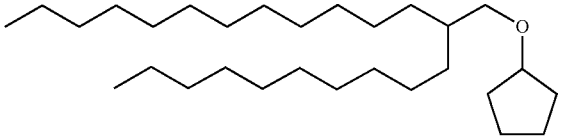 | −30 | 14.2 | 3.6 | 147 | 10.8 | — |

[1]Fatty acid
[2]Trimethylolpropane

Additionally, thermal stability of WCO feedstock, P16 and P20 bio-lubricants, and the three commercial engine oils were studied using TGA (under 40 ml/min air and heating rate of 10° C./min from room temperature to 600° C.) as shown in FIG. 30. WCO showed four decomposition peaks at 320, 367, 469 and 589° C. The peak at 469° C. was quite larger than the others, so this peak could be attributed to major triglycerides present in the WCO. The lower end peaks could represent the decomposition of FFAs while the higher end peak was possibly due to the decomposition of heavier compounds. After going through the integrated process, the maximum decomposition peak was decreased to 327-367° C. for P16 BL, and 373° C. for P20 BL mixture. All these decomposition temperatures were comparable to the commercial engine oils that showed maximum weight loss between 359-374° C.

What is claimed is:

1. A method of producing a lubricant composition, said method comprising the steps of i. hydrolyzing a starting material comprising one or more triglycerides to provide a hydrolyzed product mixture, wherein the hydrolyzed product mixture comprises one or more fatty acids, and wherein the starting material is an oil, wherein the oil is a waste cooking oil, ii. condensing the one or more fatty acids of the hydrolyzed product mixture to provide a condensation product mixture, wherein the condensation product mixture comprises an anhydride, a ketone, an ether, an acyl halide, an arene, or any combination thereof, iii. contacting the anhydride of the condensation product mixture with a cyclic compound, thereby acylating the cyclic compound to provide a coupled product mixture, and iv. hydrogenating the coupled product mixture to provide the lubricant composition.

2. The method of claim 1, wherein the hydrolyzing of step i) is performed in the presence of a catalyst.

3. The method of claim 2, wherein the catalyst is selected from the group consisting of an acid, a base, a metal oxide, and any combination thereof.

4. The method of claim 1, wherein the condensing of step ii) comprises a dehydration reaction.

5. The method of claim 1, wherein the condensing of step ii) is performed in the presence of a catalyst.

6. The method of claim 5, wherein the catalyst is selected from the group consisting of an acid, a metal, a metal oxide, a zeolite, and any combination thereof.

7. The method of claim 1, wherein the contacting of step iii) is a Friedel-Crafts acylation reaction.

8. The method of claim 1, wherein the contacting of step iii) is performed in the presence of a catalyst.

9. The method of claim 8, wherein the catalyst is selected from the group consisting of an acid, a metal, a metal oxide, a zeolite, and any combination thereof.

10. The method of claim 1, wherein the cyclic compound of step iii) is a compound selected from the group consisting of an aliphatic compound, an aromatic compound, a heterocyclic compound, a heteroaromatic compound, and any combination thereof.

11. The method of claim 1, wherein the coupled product mixture of step iii) comprises an ester, a ketone, or a combination thereof.

12. The method of claim 11, wherein the hydrogenating of step iv) comprises a hydrotreatment, wherein the hydrotreatment comprises a hydro (deoxy) genation.

13. The method of claim 1, wherein the hydrogenating of step iv) is performed in the presence of a catalyst.

14. The method of claim 13, wherein the catalyst comprises one or more transition metal, one or more noble metal, or any combination thereof.

15. A lubricant composition produced according to the method of claim 1.

16. The method of claim 1, wherein the lubricant composition comprises one or more of a cyclic oxygenated hydrocarbon (COHC).

17. The method of claim 1, wherein the condensing of step ii) is performed at a temperature of between about 25° C. and about 400° C.

18. The method of claim 11, wherein the hydrogenating of step iv) comprises partially hydrogenating the coupled product mixture.

* * * * *